US009387690B2

(12) United States Patent
Watanabe et al.

(10) Patent No.: US 9,387,690 B2
(45) Date of Patent: Jul. 12, 2016

(54) IMAGE FORMING APPARATUS FOR PERFORMING RADIATION REDUCING BACKGROUND EXPOSURE PROCESSING

(71) Applicant: CANON KABUSHIKI KAISHA, Tokyo (JP)

(72) Inventors: Shinri Watanabe, Mishima (JP); Yusuke Shimizu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/527,409

(22) Filed: Oct. 29, 2014

(65) Prior Publication Data

US 2015/0116437 A1 Apr. 30, 2015

(30) Foreign Application Priority Data

Oct. 31, 2013 (JP) ..... 2013-227194

(51) Int. Cl.

*B41J 2/44* (2006.01)
*B41J 2/47* (2006.01)
*G03G 15/043* (2006.01)

(52) U.S. Cl.

CPC *B41J 2/473* (2013.01); *B41J 2/442* (2013.01); *G03G 15/043* (2013.01); *G03G 2215/0431* (2013.01)

(58) Field of Classification Search

USPC ..... 347/228, 240, 241, 251–255; 399/53, 399/182, 183

See application file for complete search history.

(56) References Cited

U.S. PATENT DOCUMENTS

| | | | | |
|---|---|---|---|---|
| 5,764,664 | A * | 6/1998 | Yip | H04N 1/40043 372/26 |
| 8,804,217 | B2 * | 8/2014 | Zaima | 358/518 |
| 8,830,286 | B2 * | 9/2014 | Toyoizumi | B41J 2/471 347/118 |
| 2012/0147119 | A1 * | 6/2012 | Toyoizumi et al. | 347/224 |
| 2012/0230713 | A1 * | 9/2012 | Sugiyama | 399/51 |

FOREIGN PATENT DOCUMENTS

| | | | | |
|---|---|---|---|---|
| JP | 2003-287930 | A | 10/2003 | |
| JP | 2003-312050 | A | 11/2003 | |
| JP | 2012-058721 | A | 3/2012 | |
| JP | 2012-189886 | A | 10/2012 | |
| JP | 2013-164511 | A | 8/2013 | |
| JP | 2013164511 | A * | 8/2013 | G03G 15/04 |

* cited by examiner

*Primary Examiner* — Kristal Feggins
*Assistant Examiner* — Kendrick Liu
(74) *Attorney, Agent, or Firm* — Canon USA Inc. IP Division

(57) ABSTRACT

An image forming apparatus includes a signal generation unit configured to generate a light-emission signal. The signal generation unit stores information relating to a toner non-adherent area oriented light-emission pattern having been set beforehand. The toner non-adherent area oriented light-emission pattern is a light-emission pattern that causes a light irradiation unit to emit light in such a way as to prevent toner particles from adhering to a photosensitive member. When the light irradiation unit scans respective portions corresponding to two pixels adjacently disposed in a scanning direction a based on a part of the light-emission signal generated based on the toner non-adherent area oriented light-emission pattern, at least one of (a) light-emission start timing of light irradiation unit and (b) light-emission termination timing of the light irradiation unit is differentiated between the two pixels.

22 Claims, 34 Drawing Sheets

TRANSFER COMPLETED

CHARGING

EXPOSURE

DEVELOPMENT

TRANSFER

TRANSFER COMPLETED

CHARGING

EXPOSURE

DEVELOPMENT

TRANSFER

TRANSFER COMPLETED

CHARGING

EXPOSURE

DEVELOPMENT

TRANSFER

CENTRAL LIGHT EMISSION

UPSTREAM LIGHT EMISSION

DOWNSTREAM LIGHT EMISSION
PRINT IMAGE CLOCK Pclk
VIDEO SIGNAL 205
IMAGE DATA 902
Tclk
L
H
L
Tex = Tex_c
Tex = Tex_u
Tex = Tex_l
Wex

BACKGROUND EXPOSURE PATTERN

UNNECESSARY RADIATION NOISE

IMAGE FORMING APPARATUS FOR PERFORMING RADIATION REDUCING BACKGROUND EXPOSURE PROCESSING

BACKGROUND OF THE INVENTION

1. Field of the Invention

The present invention relates to an image forming apparatus (e.g., a color laser printer, a color copy machine, or a color facsimile) that performs an image forming operation including electrophotographic processes. In particular, the present invention relates to a technique which can reduce unnecessary radiations that may be emitted from the image forming apparatus.

2. Description of the Related Art

An electrophotographic color image forming apparatus forms a latent image by causing a light irradiation unit to irradiate a charged photosensitive member with light (i.e., perform an exposure operation), and forms a toner image on the photosensitive member by causing a developing device to adhere toner particles to the latent image on the photosensitive member.

Usually, the light irradiation unit irradiates a limited area of the photosensitive member (i.e., a toner adherent area) with light. However, as discussed in Japanese Patent Application Laid-Open No. 2012-58721, for the purpose of maintaining an electrical potential of a toner non-adherent area of the photosensitive member at an appropriate level to suppress the generation of a faulty image, it is conventionally known that the light irradiation unit irradiates the toner non-adherent area of the photosensitive member with a very small quantity of light in such a way as to prevent toner particles from adhering to the photosensitive member. The above-described minute exposure for the toner non-adherent area is generally referred to as "background exposure."

To express the density of an image, the light-emission time of a light source of the light irradiation unit can be changed for each pixel. For example, performing a pulse width modulation control is effective to change the exposure amount because the time interval of drive current flowing in the light source is adequately adjustable. To perform background exposure processing based on the above-mentioned pulse width modulation applied to the drive current, the drive current flows during a minute time period by an amount required to obtain a very small quantity of light.

FIG. 19 illustrates image data and a video signal in a case where pixels to be subjected to the background exposure processing are continuously arrayed. As illustrated in FIG. 19, minute time period light emission is performed for each pixel, in which the minute time period corresponds to a very small quantity of light less than one pixel.

When the pixels to be subjected to the background exposure processing are continuously arrayed, drive current repeating at a constant interval and having a minute time period flows in the light source. In this case, a significant amount of current flows across a driving circuit of the light source or a cable supplying current to a power source line thereof. An inductance component of the power source line induces a high-frequency noise voltage.

Then, high-frequency noises included in the noise voltage induce resonance in the power source line cable. The power source line cable serves as an antenna, which can spatially emit a part of electromagnetic energy of the high-frequency noise as electromagnetic waves. The electromagnetic waves emitted in this manner are referred to as unnecessary radiations (noises).

FIG. 20A illustrates image data to be continuously subjected to the background exposure processing. FIG. 20B illustrates unnecessary radiations generated when the light source emits light based on the image data illustrated in FIG. 20A. The unnecessary radiations tend to occur greatly at specific frequencies relevant to the light-emission period of the light source.

According to the technique discussed in Japanese Patent Application Laid-Open No. 2012-58721, an image generation unit is configured to generate a background exposure oriented clock signal to perform a minute light-emission operation for the background exposure processing in addition to an image forming exposure oriented clock signal. Further, background exposure oriented clock control frequencies are decentralized within a predetermined frequency range so that the background exposure oriented minute light emission can be prevented from being periodical and the generation of unnecessary radiations can be suppressed.

However, according to the configuration discussed in Japanese Patent Application Laid-Open No. 2012-58721, it will be required to newly provide a background exposure oriented clock generation circuit to reduce unnecessary radiations, in addition to an image forming exposure oriented clock generation circuit. Therefore, the costs will increase by an amount corresponding to the newly added clock generation circuit.

SUMMARY OF THE INVENTION

The present invention is directed to an image forming apparatus that can perform background exposure processing while reducing unnecessary radiations at an inexpensive cost.

According to an aspect of the present invention, an image forming apparatus can perform image forming processing by forming a latent image on a charged photosensitive member and causing toner particles to adhere to the latent image. The image forming apparatus includes a light irradiation unit configured to emit light based on a light-emission signal corresponding to an image to be formed and form a latent image by irradiating and scanning the charged photosensitive member with light, and a signal generation unit configured to store information relating to a plurality of light-emission patterns having been set beforehand in accordance with a plurality of density levels of toner particles to be supplied to the photosensitive member and configured to generate the light-emission signal based on the information relating to the plurality of light-emission patterns. The signal generation unit is configured to generate the light-emission signal corresponding to a plurality of pixels that constitutes the image based on information relating to the light-emission patterns. The signal generation unit is configured to store information relating to a toner non-adherent area oriented light-emission pattern having been set beforehand according to a level that does not cause toner particles to adhere to the photosensitive member. The toner non-adherent area oriented light-emission pattern is a light-emission pattern that causes the light irradiation unit to emit light in such a way as to prevent the toner particles from adhering to the photosensitive member. When the light irradiation unit scans respective portions corresponding to two pixels adjacently disposed in a scanning direction based on a part of the light-emission signal generated based on the toner non-adherent area oriented light-emission pattern, at least one of (a) light-emission start timing of the light irradiation unit and (b) light-emission termination timing of the light irradiation unit is differentiated between the two pixels.

Further features and aspects of the present invention will become apparent from the following detailed description of exemplary embodiments with reference to the attached drawings.

DESCRIPTION OF THE EMBODIMENTS

Various exemplary embodiments, features, and aspects of the invention will be described in detail below with reference to the drawings. The description of the following exemplary embodiments is a mere example and does not intend to narrowly limit the scope of the present invention.

[Image Forming Apparatus]

Figure 2:
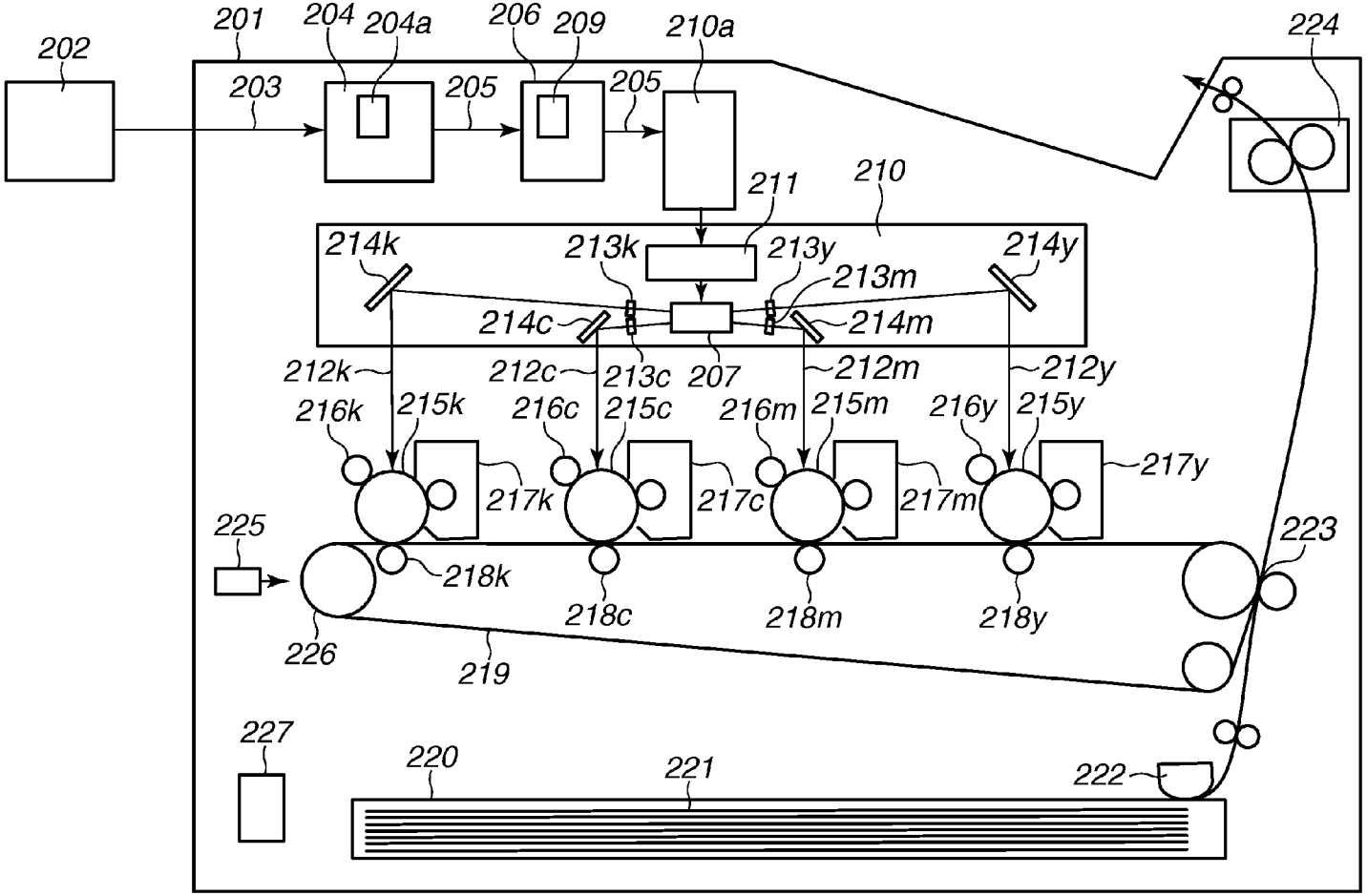
FIG. 2 is a schematic cross-sectional view illustrating an image forming apparatus.

An image forming apparatus according to a first exemplary embodiment is described in detail below. FIG. 2 is a schematic cross-sectional view illustrating a configuration of a color laser beam printer 201 that is operable as the image forming apparatus according to the present invention. The image forming apparatus according to the present invention includes four color image forming units that can cooperatively form a color image by superposing four-color (Y: yellow, M: magenta, C: cyan, and Bk: black) images.

Figure 3:
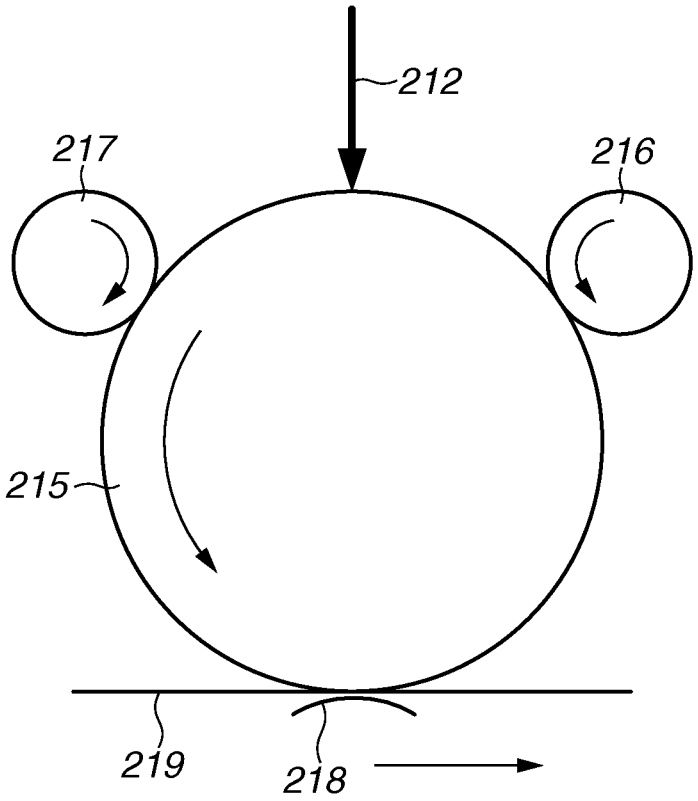
FIG. 3 illustrates a transition of photosensitive drum surface potential.

FIG. 3 is an enlarged view illustrating one image forming unit. Each image forming unit includes a photosensitive drum 215 (215*y*, 215*m*, 215*c*, or 215*k*) that is operable as a photosensitive member, a charging device 216 (216*y*, 216*m*, 216*c*, or 216*k*) that can uniformly charge the surface of the photosensitive drum 215, and a light irradiation unit (a scanner unit 210) that can irradiate the charged surface of the photosensitive drum 215 with light 212 (laser beam 212*y*, 212*m*, 212*c*, or 212*k*) to form an electrostatic latent image. The image forming unit further includes a developing device 217 (217*y*, 217*m*, 217*c*, or 217*k*) that can visualize the formed electrostatic latent image by applying toner particles to the electrostatic latent image, and a transfer device 218 (218*y*, 218*m*, 218*c*, or 218*k*) that can transfer a toner image developed on the photosensitive drum surface to an intermediate transfer belt.

Next, toner image forming processes of the color laser beam printer 201 are described in detail below. If the color laser beam printer 201 receives print data 203 from a host computer 202, an image processing unit 204 develops and converts the print data 203 into image data of an image to be formed. Then, the image processing unit 204 generates a video signal 205 (i.e., an exposure oriented video signal formatted data) for each of four colors based on the image data. The image processing unit 204 transmits the generated video signal 205 to an image forming control unit 206. Subsequently, the image forming control unit 206 transmits the video signal 205 to a laser driving unit 210*a* included in the scanner unit 210.

The laser driving unit 210*a* is provided in the scanner unit 210. The laser driving unit 210*a* applies drive current to each of four laser diodes 211 provided in the scanner unit 210, which are dedicated to four colors (Y, M, C, and K), based on the video signal 205 to drive each laser diode (cause each laser diode to emit light). The image processing unit 204 includes a central processing unit (CPU) 204*a* that is operable as an arithmetic processing unit. The image forming control unit 206 includes a CPU 209 that is operable as an arithmetic processing unit.

A rotary polygon mirror 207 can reflect the laser beam 212*y*, 212*m*, 212*c*, or 212*k* (hereinafter, referred to as "the laser beam 212") emitted from the laser diode. The laser beam 212 reflected by the polygon mirror 207 can reach scanning mirrors 214*y*, 214*m*, 214*c*, and 214*k* (hereinafter, referred to as "scanning mirror 214") after passing through lenses 213*y*, 213*m*, 213*c*, and 213*k* (hereinafter, referred to as "lens 213"). Each photosensitive drum 215 can be irradiated with the laser beam 212 reflected by the scanning mirror 214.

After passing through the lens 213, the laser beam 212 forms an image having a desired spot shape on the surface of the photosensitive drum 215. While the polygon mirror 207 is rotating, the spot of the laser beam 212 moves (deflects) in a rotational axis direction of the photosensitive drum (i.e., a direction perpendicular to the drawing surface in FIG. 2). In this case, the laser beam 212 is turned on (light emission) and off (quenching) based on the video signal in such a way as to perform main scanning (scanning of image data in a main scanning direction) for one line.

On the other hand, while the photosensitive drum 215 rotates, the position of the surface of the photosensitive drum 215 shifts in a sub scanning direction (i.e., in the circumferential direction of the photosensitive drum 215) relative to the spot of the laser beam 212. The color laser beam printer 201 repeats the above-mentioned one-line scanning a plurality of times. Through the above-mentioned processing, it is feasible to accomplish the scanning operation by irradiating a two-dimensional area extending in both the main scanning direction and the sub scanning direction with the laser beam 212 on the surface of the photosensitive drum 215.

While rotating each photosensitive drum 215, the charging device 216 (i.e., a charging roller) charges the surface of the photosensitive drum 215 to have a desired charging amount. Then, the above-mentioned scanning using the irradiation of the laser beam 212 is performed to selectively lower the surface potential of the photosensitive drum 215 based on the image data. As a result, an electrostatic latent image reflecting the image data can be formed on the surface of each photosensitive drum 215. Next, the developing device 217 (e.g., a development roller) causes toner particles to adhere to a portion corresponding to the electrostatic latent image on each photosensitive drum 215. More specifically, the developing device 217 forms a toner image on the photosensitive drum 215 by causing toner particles to adhere to the surface of the photosensitive drum 215 at the density corresponding to the electrical potential of the electrostatic latent image.

The color of toner particles is differentiated for each image forming unit. The toner particles to be supplied to the photosensitive drum 215Y are yellow. The toner particles to be supplied to the photosensitive drum 215M are magenta. The toner particles to be supplied to the photosensitive drum 215C are cyan. The toner particles to be supplied to the photosensitive drum 215K are black. The toner image formed on each photosensitive drum 215 can be primarily transferred to an endless belt (hereinafter, referred to as "intermediate transfer belt") 219 in a state where an appropriate bias voltage is applied to the transfer device 218 (e.g., a primary transfer member). In the primary transfer operation, the intermediate transfer belt 219 is rotated by a driving roller and is controlled in such a way as to equalize the moving speed of the surface of the intermediate transfer belt 219 with that of the surface of the photosensitive drum 215.

The primary transfer operation is successively performed in the order of yellow, magenta, cyan, and black in synchronization with the movement of the surface of the intermediate transfer belt 219 in such a way as to superpose toner images of respective colors on the intermediate transfer belt 219. As a result of superposing the toner images of respective colors, a composite color toner image can be formed on the intermediate transfer belt 219.

A paper feeding roller 222 can successively feed recording papers 221 from a cassette 220. Each recording paper 221 is then conveyed to a secondary transfer portion 223, at which a secondary transfer operation can be performed, in synchronization with the image primarily transferred on the intermediate transfer belt 219. Thus, the image can be transferred onto the recording paper. In this case, to increase the transfer efficiency, an appropriate bias voltage is applied to a secondary transfer roller. A fixing device 224 can apply heat and pressure to the recording paper to thermally fix the secondarily transferred image. Finally, a color image can be stably fixed on the recording paper and can be discharged via a paper discharge portion.

[Surface Potential of Photosensitive Drum]

Next, transition of the surface potential of the photosensitive drum 215 in the toner image forming process is described in detail below with reference to FIGS. 4A, 4B, 4C, 4D, and 4E.

Figure 4A:
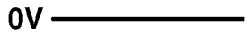
FIGS. 4A to 4E illustrate a transition of photosensitive drum surface potential.

First, the surface potential of the photosensitive drum 215 is substantially 0 V (see FIG. 4A). When the image forming operation is started, the charging roller 216 uniformly charges the surface of the photosensitive drum to have a desired polarity (e.g., surface potential VD=−800 V) (see FIG. 4B). Next, the photosensitive drum 215 is exposed to the laser beam 212 and an electrostatic latent image is formed on the surface of the photosensitive drum 215 (see FIG. 4C). The surface potential of the photosensitive drum, on which the electrostatic latent image is formed, changes from VD to an exposed area potential VL (−200 V) at only an area where the photosensitive drum is exposed to the laser beam.

In a development process to visualize the electrostatic latent image, the electrostatic latent image formed on the photosensitive drum 215 is developed with toner particles by applying a predetermined voltage to the development roller 217 in such a way as to form a visualized toner image on the photosensitive drum 215. In the development of the toner image on the photosensitive drum 215, toner particles adhere to the exposed area of the surface of the photosensitive drum 215, at a developing device opposing position, so that the surface potential of the photosensitive drum 215 becomes VDC (approximately −400 V) (see FIG. 4D).

Subsequently, the transfer device 218 applies a transfer bias. The toner image developed on the surface of the photosensitive drum 215 is transferred to the intermediate transfer belt 219. In the transfer completed state, the electrical potential of the photosensitive drum 215 is in a range from −100 to +500 V (see FIG. 4E).

Figure 4B:
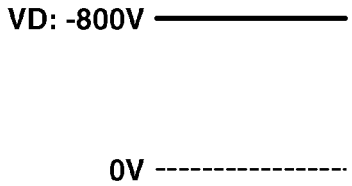
Figure 4C:
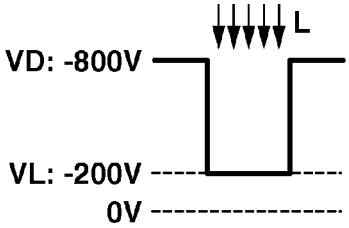
Figure 4D:
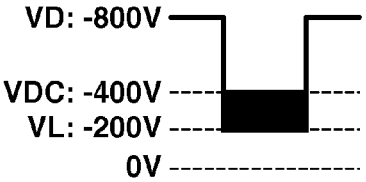
Figure 4E:
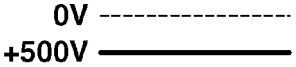

When the above-mentioned sequential (i.e., charging, exposure, development, and transfer) processes are completed, the photosensitive drum 215 is uniformly charged again so that the surface potential becomes a desired electrical potential as illustrated in FIG. 4B.

A multi-color print that can be performed by the above-mentioned color image forming apparatus is described in detail below. When a toner image is transferred to the intermediate transfer belt at an upstream image forming unit, both a toner image formed area and a toner image non-formed area are present on the intermediate transfer belt.

When the surface of the intermediate transfer belt moves and reaches a nip portion between a photosensitive drum of a downstream image forming unit and the transfer unit, there is a significant difference between the toner image formed area and the toner image non-formed area on the intermediate transfer belt with respect to the admittance between the photosensitive drum and the intermediate transfer belt.

As a result, a difference arises in transfer current flowing from the intermediate transfer belt to the photosensitive drum between the toner image formed area and the toner image non-formed area of the upstream image forming unit.

Figure 5A:
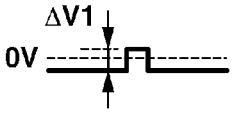
FIGS. 5A to 5E illustrate a transition of photosensitive drum surface potential.
Figure 5B:
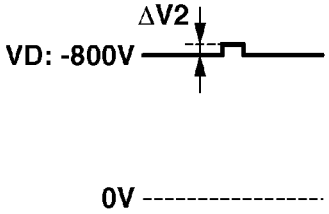

Due to the above-mentioned difference of the transfer current amount, in the downstream image forming unit, unevenness ΔV1 remains with respect to the surface potential of the photosensitive drum in the transfer completed state (see FIG. 5A). If the next toner image is formed before the above-mentioned surface potential unevenness is eliminated, a partial area ΔV2 higher than VD will remain with respect to the surface potential of the charged drum when the above-mentioned toner image forming process is performed again in a case where the surface potential unevenness cannot be sufficiently removed by the charging (see FIG. 5B).

Figure 5C:
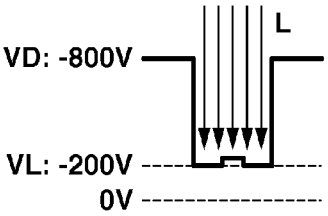
Figure 5D:
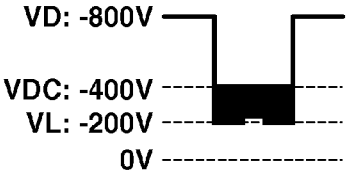
Figure 5E:
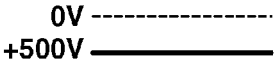

Therefore, when an electrostatic latent image is formed later through the exposure process, the surface potential of the photosensitive drum cannot be equalized to VL at an area where the surface potential unevenness occurs on the photosensitive drum. Therefore, a local area in which the electrical potential is higher than VL remains (see FIG. 5C). If a development operation is performed in this state, unevenness of toner density occurs in the development completed state because the surface potential unevenness remains on the photosensitive drum 215 when the toner development is performed.

Figure 6:
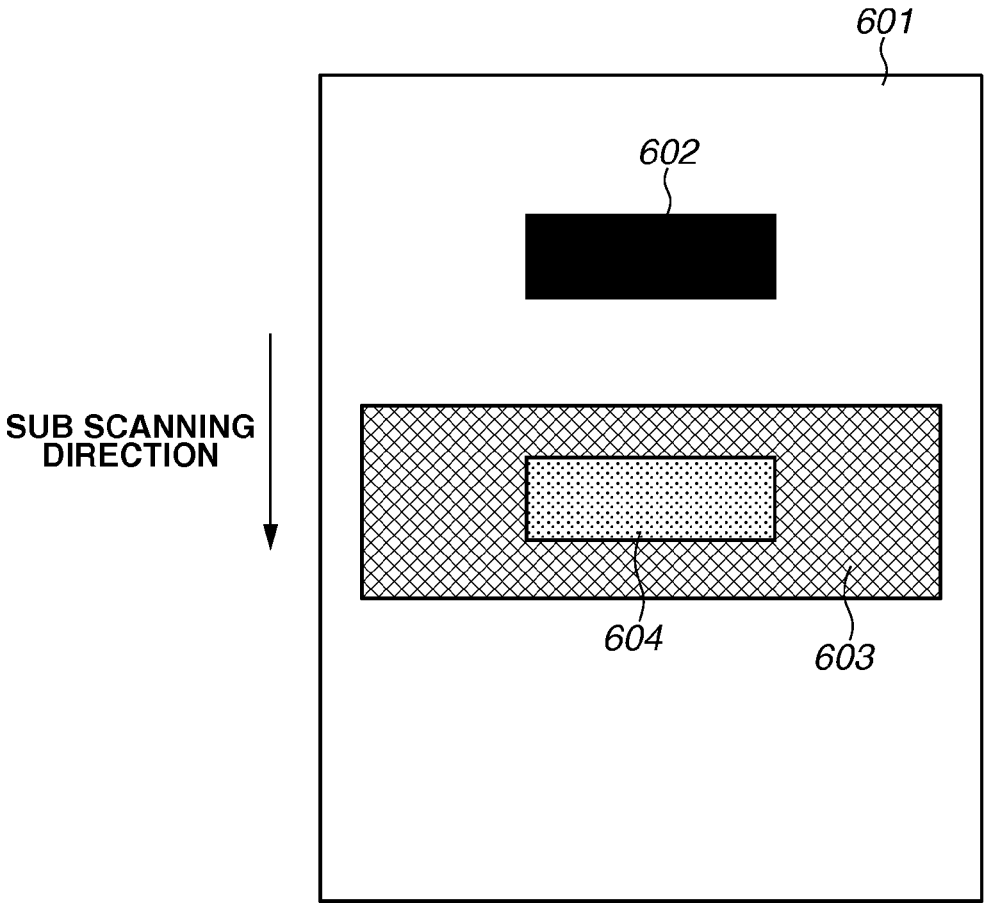
FIG. 6 illustrates an output image.

As a result, a formed image may include a partial area in which the toner density is locally lowered compared to an expected level of the image data (see FIG. 6). FIG. 6 illustrates an output image 601, an image 602 (e.g., a yellow solid pattern) formed by an upstream image forming unit, an image 603 (e.g., a black halftone image) formed by a downstream image forming unit, and an image density unevenness area 604 that is included in the image formed by the downstream image forming unit. More specifically, if the surface potential unevenness still remains even after the downstream image forming unit performs a charging operation in the transfer completed state where the surface potential of the photosensitive drum is uneven, the amount of toner particles adhered to the photosensitive drum surface will be inaccurate when the next development is performed. Thus, an obtained image will include density unevenness.

[Background Exposure]

The image forming apparatus according to the present exemplary embodiment performs background exposure processing in such a way as to eliminate the above-mentioned image density unevenness. More specifically, as illustrated in FIGS. 7A to 7E, to eliminate the surface potential unevenness in the transfer completed state, the image forming apparatus sets a charging bias setting value to be ΔV3 higher than the conventional bias setting value VD (VD'=−850 V). Thus, the surface potential unevenness of the photosensitive drum can be reduced to ΔV4 (ΔV4<ΔV2) in the charging process succeeding the transfer process (see FIG. 7B). In this case, in the charging completed state, the surface potential of the photosensitive drum is ΔV3 higher than the conventional photosensitive drum surface potential VD because the output value of the charging bias in the transfer completed state is set to be higher (VD'=−850 V). Therefore, in the exposure process, the image forming apparatus cancels the surface potential ΔV3 in such a way as to obtain a desired image density.

More specifically, the image forming apparatus exposes the photosensitive drum surface to light L1 whose quantity is greater than a conventional exposure amount L (L1>L). More specifically, the image forming apparatus exposes a toner image forming area of the photosensitive drum surface by the total exposure amount L1 and exposes a toner image non-forming area of the photosensitive drum surface by the total exposure amount L2. The latter exposure is referred to as "background exposure." In this case, the exposure amount L2 is less than the exposure amount L1 or the conventional exposure amount L (L1>L>L2).

The exposure amount L2 is a quantity of light that does not force toner particles to adhere to the photosensitive drum surface at a level visible to human eyes (recognizable as a toner image) when the photosensitive drum surface is exposed to the quantity of light L2. The exposure amount L2 is a quantity of light that lowers the line-surface of the photosensitive drum by the amount of approximately ΔV3.

By performing the above-mentioned background exposure processing, the drum surface potential of the toner image non-forming area can be set to VD and the drum surface potential of the toner image forming area can be set to VL in the exposure completed state. Therefore, it is feasible to cancel the photosensitive drum surface potential difference ΔV3 by raising the photosensitive drum surface potential (VD'=−850 V) in the charging completed state (see FIG. 7C).

Figure 7A:
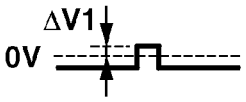
FIGS. 7A to 7E illustrate a transition of photosensitive drum surface potential.
Figure 7B:
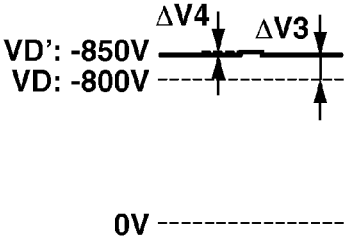
Figure 7C:
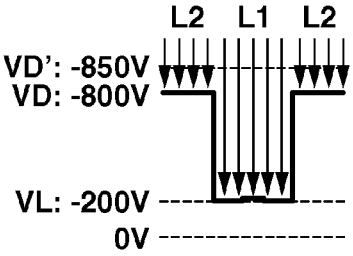
Figure 7D:
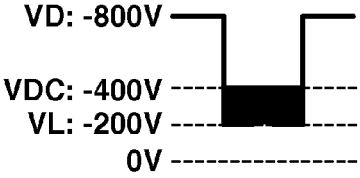
Figure 7E:
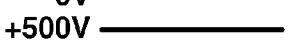
Figure 8:
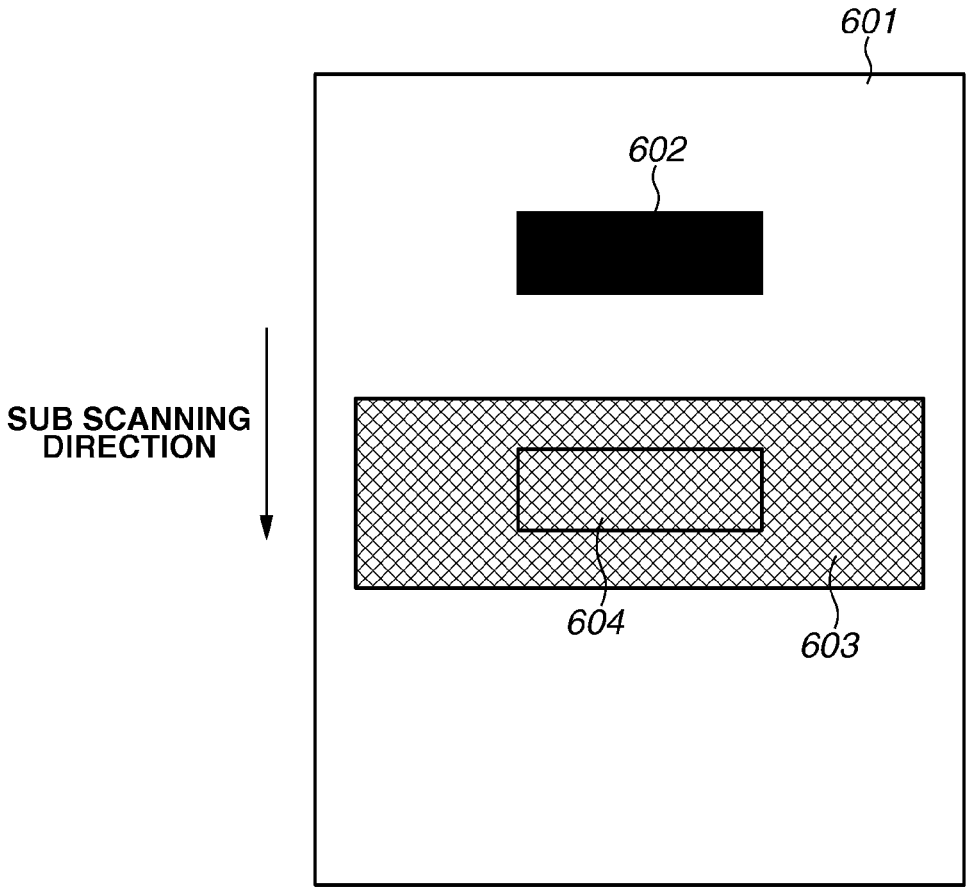
FIG. 8 illustrates an output image.

If the image forming apparatus performs a development operation in the above-mentioned state, unevenness in the development of a toner image can be reduced because the development of toner particles is performed in a state where the photosensitive drum potential unevenness is small (see FIG. 7D). As a result, a satisfactory image can be transferred to the intermediate transfer belt. As illustrated in FIG. 8, an image formed by the downstream station does not include any density unevenness.

Further, the purpose of performing the background exposure processing is not limited to the elimination of the photosensitive drum potential unevenness in the transfer completed state that has arisen from a toner image formed by the above-mentioned upstream station. For example, the image forming apparatus can perform the background exposure processing for the purpose of stabilizing the pre-exposure electrical potential regardless of endurance state of each photosensitive drum when the charging bias of the charging unit is a fixed voltage. As mentioned above, the background exposure processing intends to adjust the surface potential of the toner image non-forming area of the photosensitive drum to be an appropriate value in the exposure completed state.

[Exposure Based on Print Data]

Next, exposure processing that can be performed based on print data is described in detail below. First, to cause the scanner unit 210 to expose the photosensitive drum 215 based on print data, it is necessary to generate a video signal (i.e., a light-emission signal) according to which the scanner unit 210 can emit light. Hereinafter, processing for converting print data into a video signal is described in detail below with reference to FIGS. 9, 23A, and 23B.

[Processing for Converting Print Data into Video Signal]

The image processing unit 204 can perform conversion processing for converting the print data 203 into the video signal (light-emission signal) 205. In this respect, the image processing unit 204 is operable as a signal generation unit configured to generate the video signal 205. The CPU 204*a* can perform calculations for the conversion processing.

First, the image processing unit 204 receives the print data 203 (i.e., data corresponding to an image 901 to be printed) from the host computer 202 and converts the print data 203 into image data 902 through minimum pixel unit division processing according to a setting resolution of the image forming apparatus. Subsequently, to cause the plurality of laser diodes 211 to emit light based on the generated image data 902, the image processing unit 204 converts the image data 902 into the corresponding video signal 205. The image data 902 is information corresponding (relating) to a light-emission pattern of the scanner unit 210 that emits light based on the video signal 205.

Figure 23A:
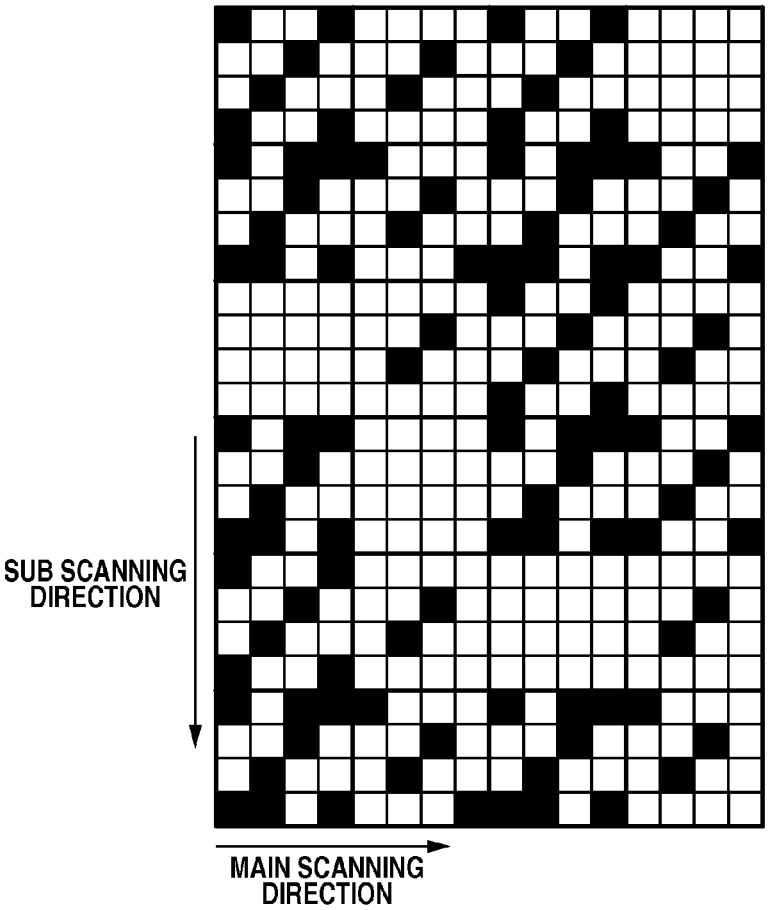
FIGS. 23A and 23B schematically illustrate multi-value dither processing.

In the process of converting the print data 203 into the image data 902, the image processing unit 204 performs dither matrix processing in which the print data 203 is subjected to multi-value dither processing and converted into the image data 902 having gradations. The multi-value dither processing is described in detail below with reference to FIGS. 23A and 23B. FIG. 23A illustrates a part of the image data 902 converted from the print data 203, in which a bold line indicates each dither matrix (i.e., a piece of the image data) obtainable by appropriately dissecting the image data 902.

The dither matrix illustrated in FIG. 23A includes sixteen pixels that form a square area composed of four pixels arrayed in the vertical direction and four pixels arrayed in the horizontal direction, as minimal unit of the dither matrix. As mentioned above, each dither matrix is a piece of image data constituted by an assembly of a plurality of pixels (i.e., a light-emission pattern represented by an assembly of a plurality of pixels). The image data is composed of a plurality of dither matrices disposed in a predetermined pattern.

Figure 23B:
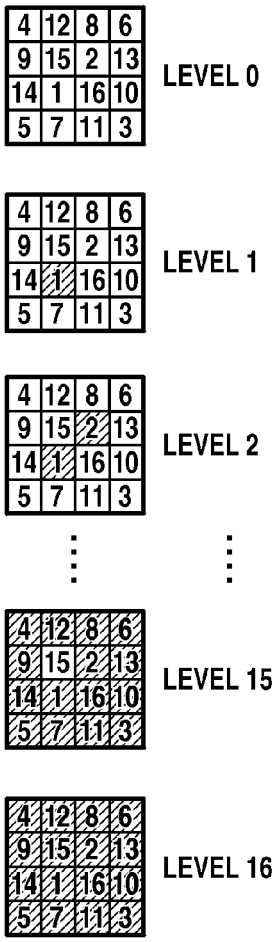

FIG. 23B illustrates the growth order of pixels in a minimal dither matrix (i.e., a basic dither matrix). Each of 16 pixels constituting the minimal dither matrix (having a square shape) is allocated a number (1 to 16) indicating the growth order. In the present exemplary embodiment, the growth of a pixel indicates enlarging the light-emission time of an attentional pixel and increasing the density of toner particles that adhere to a partial area of the photosensitive drum corresponding to the attentional pixel. Further, levels 0 to 16 are density levels of respective dither matrices. When the density level is higher, there are many grown pixels in the dither matrix. Therefore, when the density level becomes higher, the image density of the dither matrix becomes higher. Thus, it becomes feasible to obtain an area having a higher density level with respect to toner particles that adhere to the photosensitive drum in the development process.

The image processing unit 204 includes a ROM, i.e., a storage medium (not illustrated), which stores a plurality of dither matrices (levels 0 to 16 according to the example illustrated in FIG. 32B) corresponding to a plurality of density levels (gradations) of the image of the print data 203. The image processing unit 204 selects and locates a suitable dither matrix for each coordinate of the print data 203 with reference to the density level (gradation) of the coordinate and generates the image data 902 in which a dither matrix corresponding to the density level of each coordinate is disposed at each coordinate.

Figure 9:
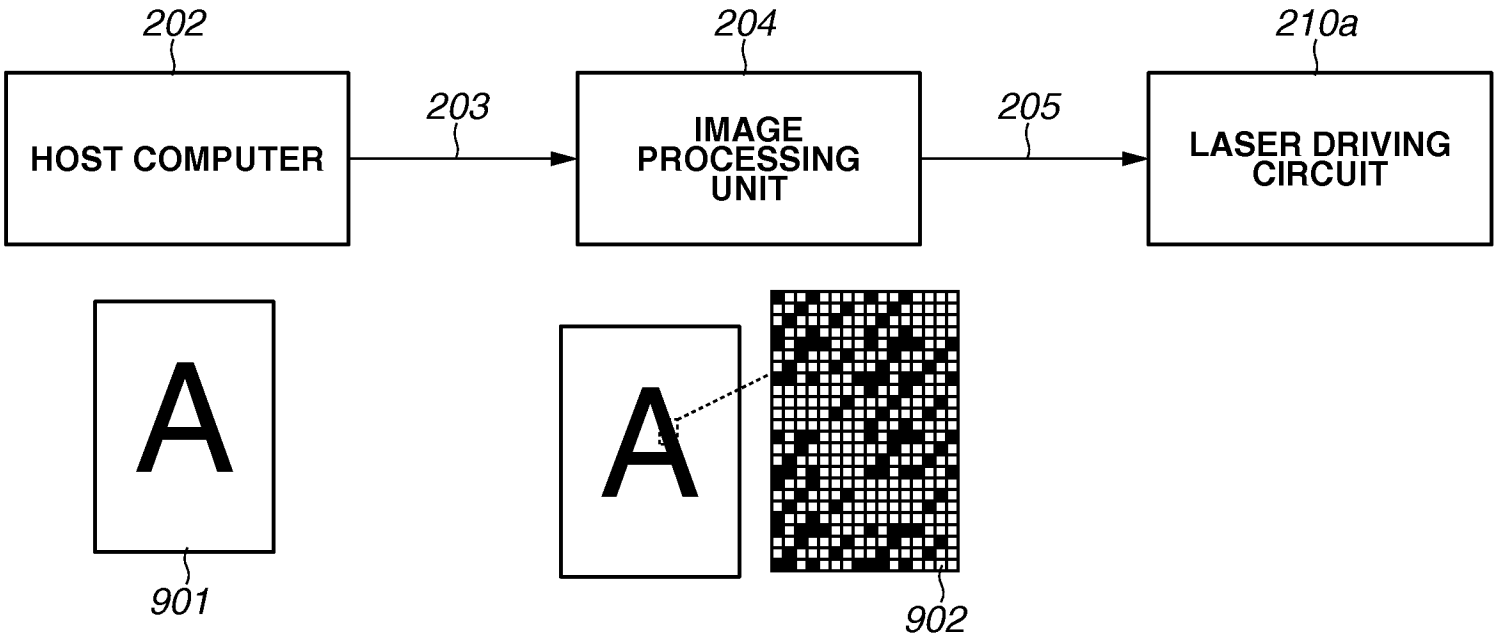
FIG. 9 is a block diagram illustrating a print data conversion method.

The dither matrices and image data illustrated in FIGS. 9, 23A, and 23B are examples corresponding to patterns to be used when the photosensitive drum is exposed. In each dither matrix, a black area corresponds to a partial area of the photosensitive drum surface that is irradiated with light and a white area corresponds to a partial area of the photosensitive drum surface that is not irradiated with light.

The image 901 and the image data 902 illustrated in FIG. 9 and the image data illustrated in FIG. 23A are mere examples. In an actual operation, the image forming apparatus can print an arbitrary image. Further, the way of letting the pixels grow in the minimal dither matrix is not limited to the example illustrated in FIG. 23B. The density growth rate in each pixel can be arbitrarily set. For example, the pixel density can be increased from 0% to 100% in response to only one level change. Alternatively, it is useful to let each pixel grow through a plurality of stages in such a way as to initially increase from 0% to 50% in response to one level change and then increase from 50% to 100% in response to another level change. Further, it is useful to let a plurality of pixels simultaneously grow in response to one level increase.

The image processing unit 204 generates the video signal 205 based on the image data 902 and outputs the video signal 205 to the laser driving unit 210*a* via the image forming control unit 206 (see FIG. 2) in synchronization with an image clock Pclk. The image clock Pclk is a clock signal that can be generated by a clock generation unit 204*b* provided in the image processing unit 204. While the photosensitive drum 215 is scanned with the laser beam (i.e., during a period in which a spot can be formed on the photosensitive drum 215 by irradiating with the laser), the image clock Pclk to be generated by the clock generation unit 204*b* has a fixed frequency (e.g., 20 MHz in the present exemplary embodiment). To simplify the drawing, the image forming control unit 206 is not illustrated in FIG. 9.

The video signal 205 is a signal usable to cause a light source (the laser diode 211) of the exposure device (the scanner unit 210) to emit light. By causing the light source to emit light based on the video signal 205, the photosensitive drum can be exposed to a pattern similar to the image data 902. Therefore, the image processing unit 204 generates the video signal 205 by serially arraying the pixels of the image data 902 in the order of irradiating the photosensitive drum with light.

In a case where the exposure device uses the polygon mirror 207, the order according to which the exposure device irradiates the photosensitive drum with light is the order according to which the spot of the laser beam 212 moves on the photosensitive drum. More specifically, when a row of pixels arrayed in the main scanning direction constitutes a main scanning line, the order is as follows. First, the exposure device irradiates a first main scanning line with light in the order advancing from the upstream side to the downstream side in the main scanning direction (namely performs a first scanning operation) and then irradiates a second main scanning line, positioned on the downstream side of the first main scanning line in the sub scanning direction, with light similarly in the order advancing from the upstream side to the downstream side in the main scanning direction.

The video signal 205 according to the present exemplary embodiment is a signal causing the laser driving unit 210*a* to take two states (i.e., two phases), one of which is an "H" state in which current is supplied to the laser diode 211 to emit light and the other state is an "L" state in which no current is supplied to the laser diode. Therefore, the light-emission pattern (i.e., ON/OFF switching pattern) of the laser diode 211 corresponds to the "H"/"L" switching pattern of the video signal 205. In the present exemplary embodiment, the video signal 205 is a differential signal.

Figure 10:
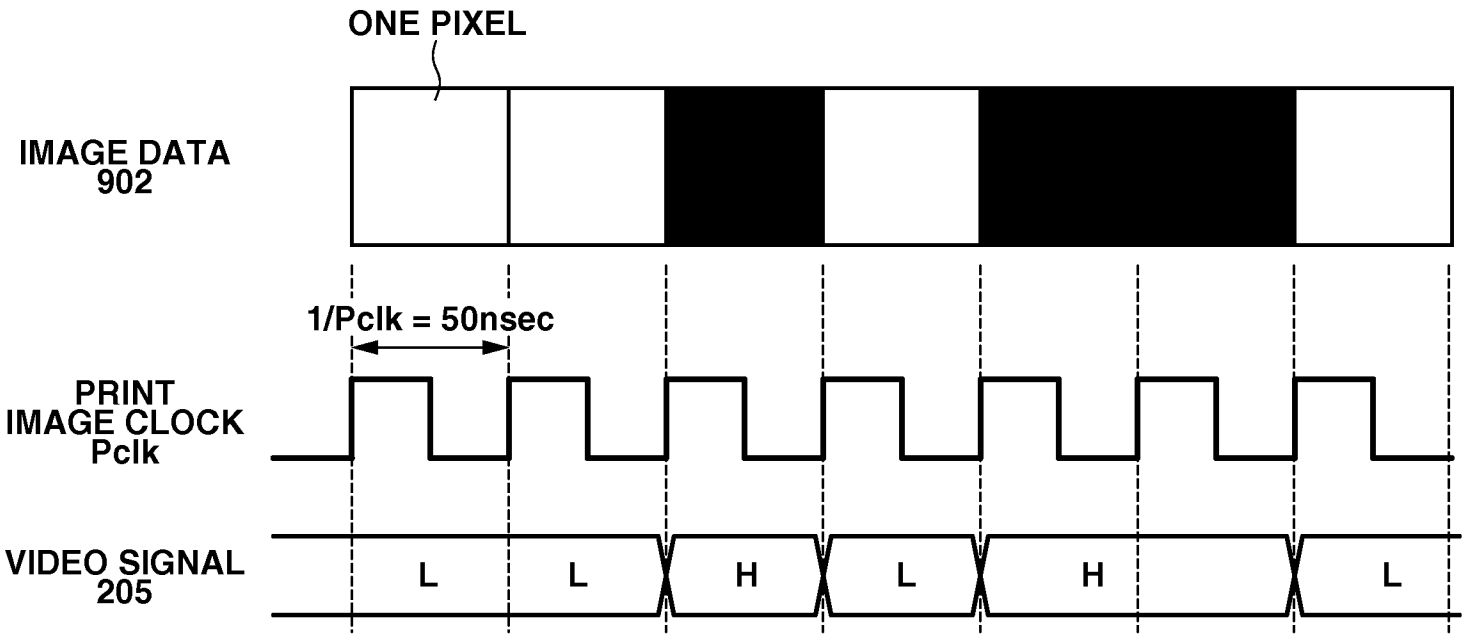
FIG. 10 illustrates image data in relation to a video signal.

Next, the video signal 205 is described in detail below with reference to FIG. 10, FIG. 11, and FIGS. 12A, 12B, and 12C, in relation to the image data, the light-emission pattern, and the image clock Pclk. FIG. 10 illustrates an example of the relationship between the image data 902, the image clock Pclk, and the video signal 205. When the image clock Pclk is 20 MHz, one pixel scanning time by the spot of the laser beam 212 is 50 nsec (=1/Pclk. FIG. 10 illustrates an example in which the video signal 205 being set to "H" or "L" for each pixel is output in synchronization with the rise timing of the image clock Pclk.

Figure 11:
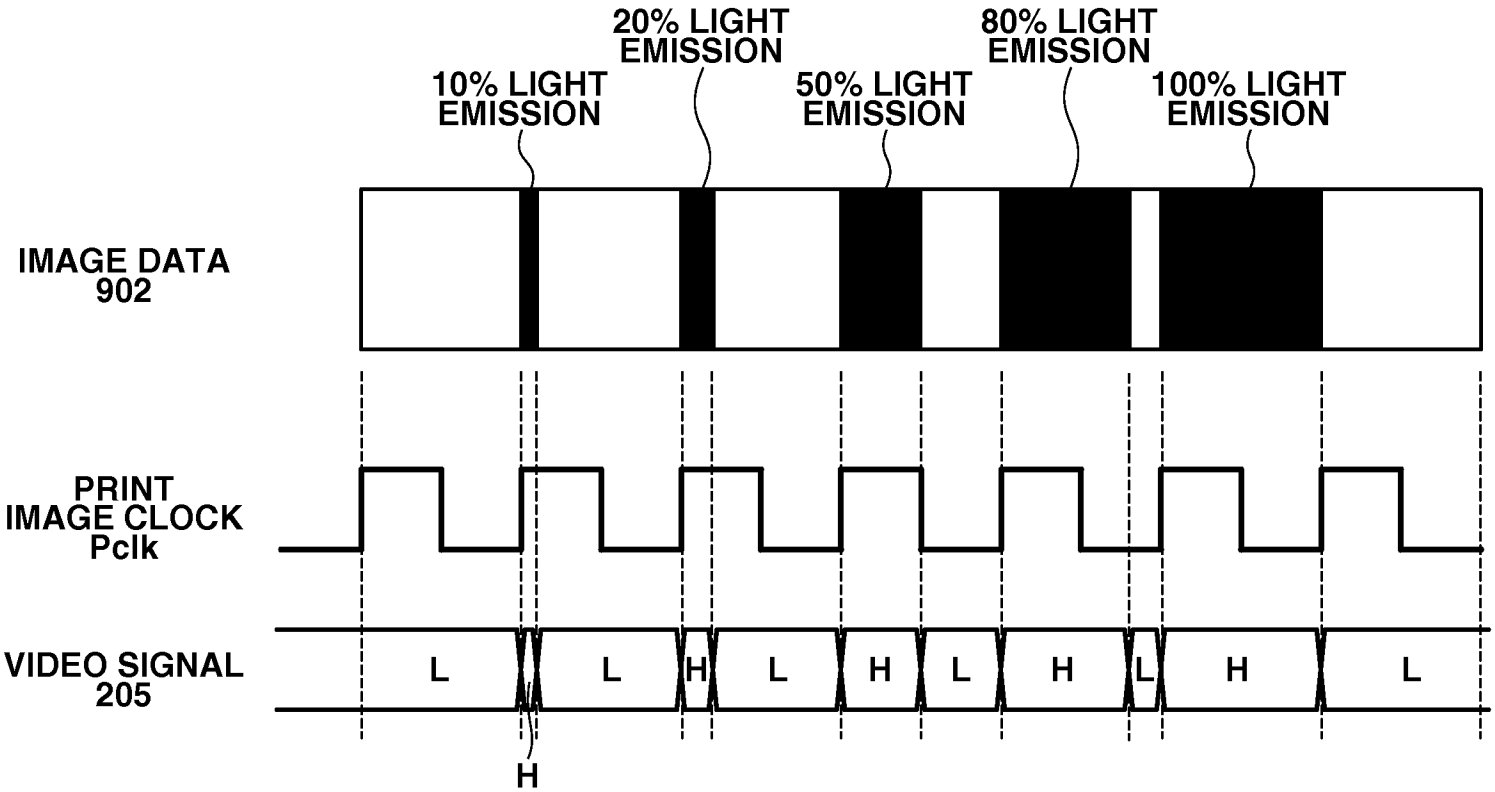
FIG. 11 illustrates image data in relation to a video signal.

FIG. 11 illustrates an example in which the video signal 205 being switched between "H" and "L" at intervals shorter than one pixel scanning period is output in synchronization with the rise timing of the image clock Pclk. In the present exemplary embodiment, the clock generation unit 204*b* generates a switching clock signal for switching between "H" and "L" by multiplying the image clock Pclk. The image processing unit 204 performs switching between "H" and "L" in synchronization with the generated switching clock. The generated switching clock signal has a fixed frequency because the image clock Pclk has a fixed frequency. More specifically, the timing for switching the output of the video signal 205 between "H" and "L" is timing synchronized with either rise or fall of the switching clock having the above-mentioned fixed frequency.

As mentioned above, a laser emission time rate (0% to 100%) during one pixel scanning period can be controlled by arbitrarily setting the length of the "H" state during one pixel scanning period. When the laser emission time rate during one pixel scanning period is larger, the density of toner particles that adhere to an area corresponding to the pixel on the photosensitive drum surface becomes higher. A time unit to control the laser emission time corresponds to one period of the switching clock. For example, when the frequency of the switching clock is 32 times the image clock Pclk, a minimal unit settable to control the laser emission time rate is a fragmentary pixel having a length comparable to 1/32 of one pixel.

Figures 12A, 12B, 12C:
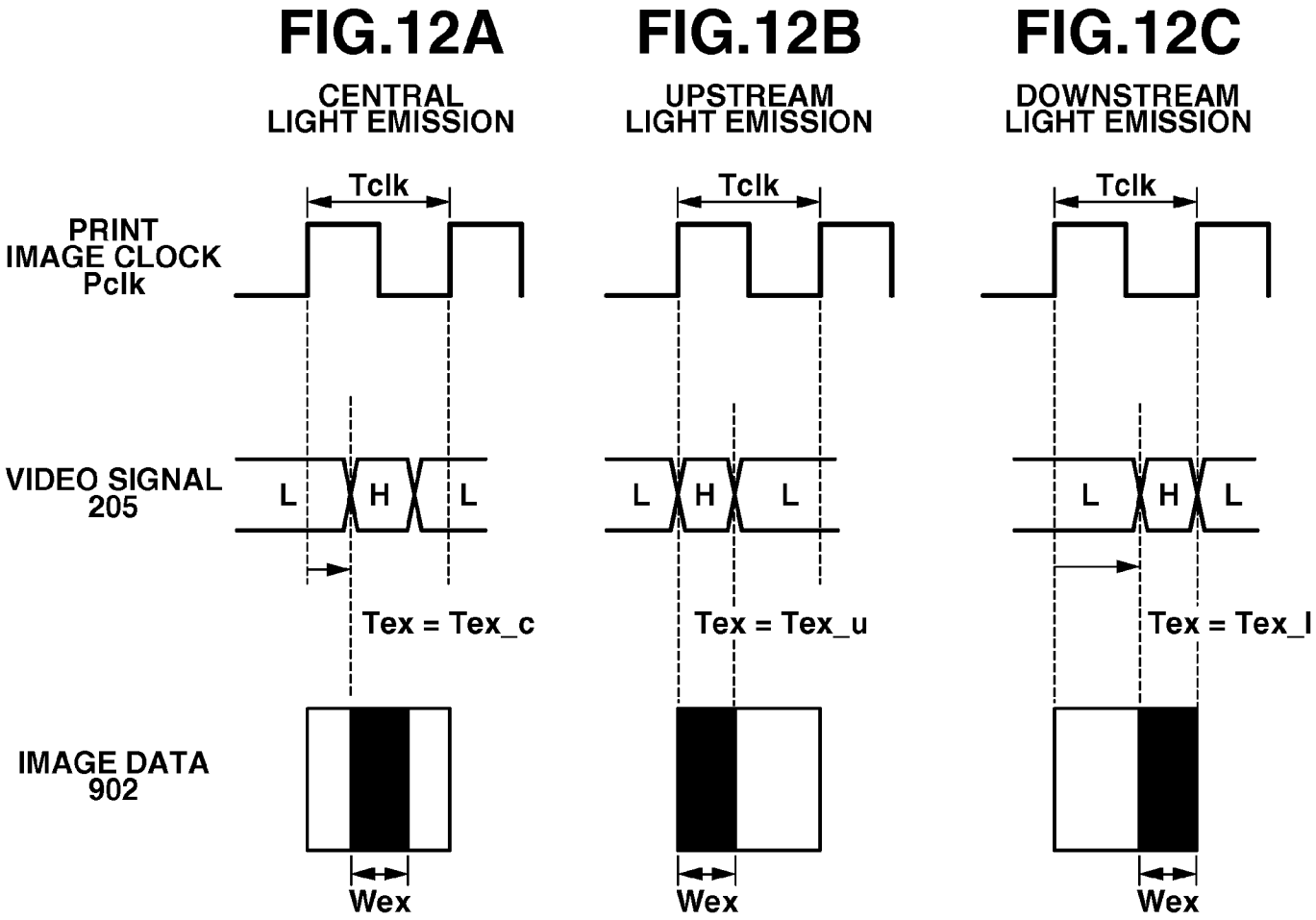
FIGS. 12A, 12B, and 12C illustrate image data in relation to a video signal.

Further, FIGS. 12A, 12B, and 12C illustrate examples of the laser emission performed at an upstream position, a central position, and a downstream position of one pixel in the scanning direction. In each of FIGS. 12A, 12B, and 12C, Tclk represents an one pixel scanning time of the light spot (Tclk=1/Pclk), Wex represents a light-emission period (period in which "H" state is maintained), and Tex represents a period from the rise timing of the image clock to the laser emission start (switching from "L" state to "H" state) timing.

In FIG. 12A, Tex_c represents laser emission start timing in a case where the laser emission is performed at the center of one pixel. Namely, Tex=Tex_c=(Tclk−Wex)/2. In FIG. 12B, Tex_u represents laser emission start timing in a case where the laser emission is performed at the upstream side in the main scanning direction. Namely, Tex=Tex_u=0. In FIG. 12C, Tex_1 represents laser emission start timing in a case where the laser emission is performed at the downstream side in the main scanning direction. Namely, Tex=Tex_L=Tclk−Wex. Thus, the laser emission can be performed at anywhere of one pixel.

[Background Exposure Method]

A background exposure method according to the present exemplary embodiment is described in detail below. In the background exposure processing, the photosensitive drum is exposed in such a way as to prevent toner particles from adhering to the photosensitive drum at the level visible to human eyes (recognizable as a toner image). Therefore, the light source is caused to emit light by a light-emission time that is equal to or less than one pixel scanning period.

For example, setting the light-emission width to be comparable to approximately 10% of one pixel is useful to lower the surface potential of the photosensitive drum from VD' to VD. The surface potential of the pre-development photosensitive drum can be maintained at a potential level which can prevent toner particles from adhering to the photosensitive drum in the development process.

Each pixel to be subjected to the above-mentioned exposure processing for maintaining the surface potential of the pre-development photosensitive drum at the electrical potential which can prevent toner particles from adhering to the photosensitive drum in the development process is referred to as "background exposure pixel" or "minute exposure pixel." In the background exposure, an appropriate light-emission width for each pixel is relevant to a difference between surface potentials VD' and VD of the photosensitive drum. When the difference is larger, a greater amount of light-emission width is necessary.

In the process of converting the above-mentioned print data 203 into the video signal 205, the image processing unit 204 allocates a level-0 dither matrix to each coordinate of a toner image non-forming area (i.e., a white area in which the image density of the print data 203 is lowest. In the present exemplary embodiment, the level-0 dither matrix is a piece of image data to be subjected to the background exposure. A piece of image data to be subjected to the background exposure is an assembly of pixels that have the light-emission width (i.e., the minute pulse width) which can prevent toner particles from adhering to the photosensitive drum at the level visible to human eyes (can be recognized as a toner image) when the photosensitive drum is exposed.

In other words, the level-0 dither matrix corresponds to a toner non-adherent area oriented light-emission pattern having been set beforehand as a fundamental level that does not cause toner particles to adhere to the photosensitive drum. Further, a portion corresponding to the toner non-adherent area oriented light-emission pattern of the video signal 205 is a toner non-adherent area oriented light-emission signal.

The scanner unit 210 performs a laser beam emission operation based on a part of the video signal 205 that corresponds to an image data portion generated with reference to the level-0 dither matrix and performs background exposure processing in such a way as to expose the photosensitive drum 215 by scanning the photosensitive drum 215.

The image processing unit 204 allocates a level-1 or higher level dither matrix (a piece of the image data) to each coordinate of a toner image forming area of the print data 203 other than the white area. The level-1 or higher level dither matrix includes at least one pixel (see levels 1 to 31 of the dither matrix illustrated in FIG. 23B) having a light-emission width that causes toner particles to adhere to the photosensitive drum in such a way as to expose the photosensitive drum at a level visible to human eyes (recognizable as a toner image).

[Problem Caused by Background Exposure]

Figure 20A:
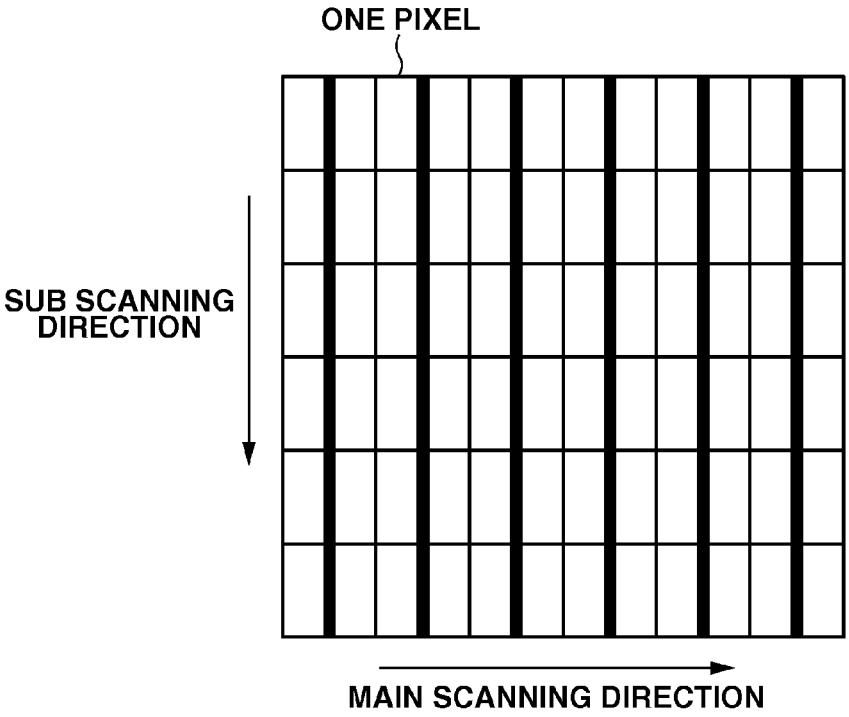
FIG. 20A illustrates image data obtainable through conventional background exposure continuously performed.

However, for example, as illustrated in FIG. 20A, in a case where the light-emission width of each pixel in the level-0 dither matrix is the minute pulse width, a plurality of pixels having the minute pulse width is continuously arrayed in the main scanning direction. Accordingly, when image data including the level-0 dither matrix is converted into a video signal and output to the laser driving unit 210*a*, drive current repeating at a constant interval and having a minute time period flows in a laser driving circuit that supplies drive current to the laser diode 211 of the laser driving unit 210*a*.

Thus, current flows in the laser driving circuit of the laser driving unit or a cable of a current supply power source line. A high-frequency noise voltage is generated due to an inductance component of the line. Then, high-frequency noises included in the noise voltage induce resonance in the power source line cable. The power source line cable serves as an antenna, which spatially emits a part of electromagnetic energy of the high-frequency noises as electromagnetic waves. The electromagnetic waves generated in this manner are unnecessary radiations (noises).

[Background Exposure Light-Emission Pattern]

Therefore, in the present exemplary embodiment, even when a plurality of pixels whose light-emission width is the minute pulse width is continuously disposed in the scanning direction, the image forming apparatus sets level-0 dither matrices in such a way as to form a background exposure pattern that does not cause current to flow periodically (causes current to flow non-periodically) in the laser driving circuit of the laser driving unit 210*a*. The background exposure pattern that does not cause current to flow periodically in the laser driving circuit of the laser driving unit 210*a* is a light-emission pattern according to which the timing of the light emission performed at the minute pulse width is non-periodic and the light-emission width of the minute pulse (i.e., light-emission period) is not constant.

Figure 13:
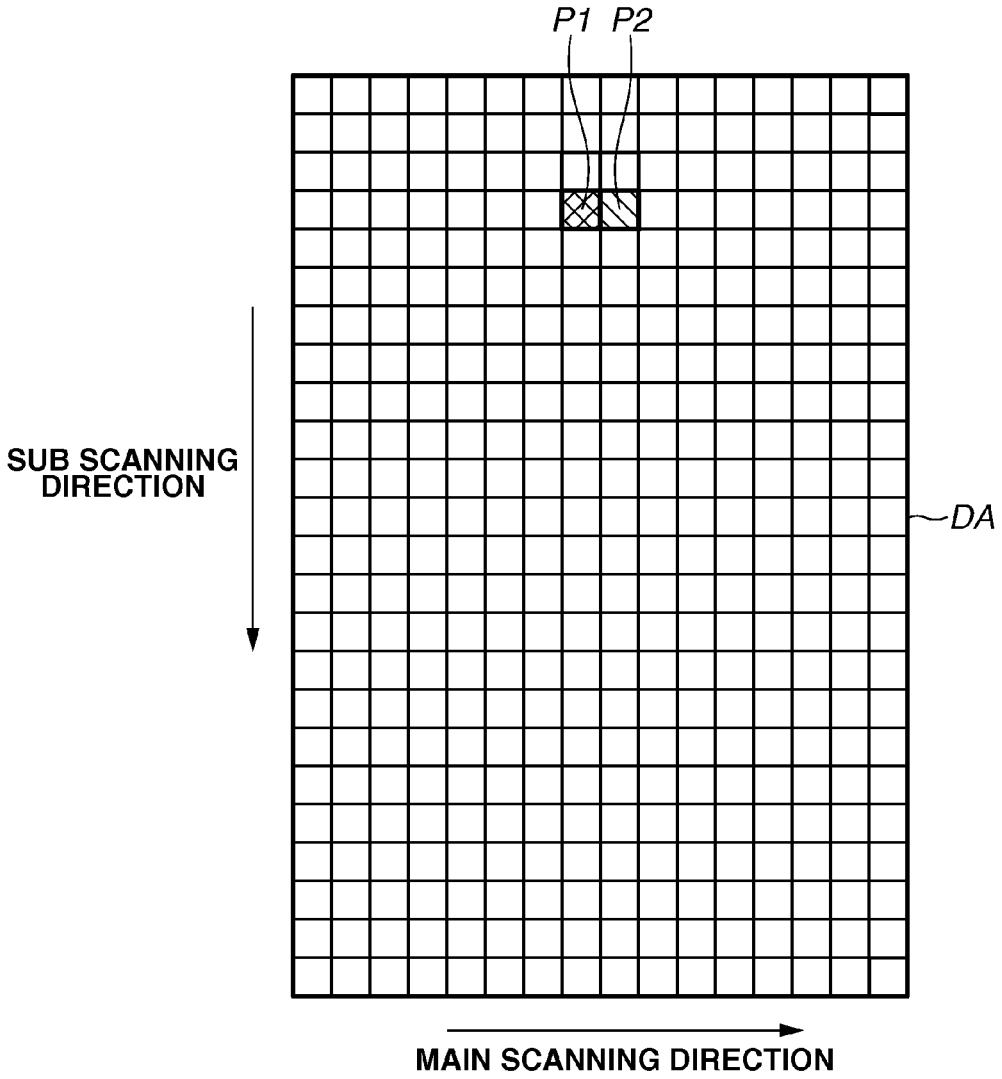
FIG. 13 illustrates pixels positioned outside a toner image non-forming area.

More specifically, in a toner image non-forming area DA composed of pixels to be subjected to the background exposure processing, two pixels neighboring each other in the scanning direction are referred to as a first pixel P1 and a second pixel P2 as illustrated in FIG. 13. In this case, when the scanner unit 210 scans the first pixel P1 and the second pixel P2, the scanner unit 210 differentiates the laser emission start timing and/or the laser emission termination timing relative to an image clock reference point.

More specifically, the first pixel P1 and the second pixel P2 are different from each other with respect to the laser emission start timing and/or the laser emission termination timing in each pixel. The scanning direction is a moving direction of the scanning light spot on the surface of the photosensitive drum. In the present exemplary embodiment, the scanning direction is the main scanning direction along which the spot of the laser beam 212 moves when the polygon mirror 207 rotates.

Next, an example of the background exposure pattern is described in detail below with reference to the first pixel P1 and the second pixel P2 adjacently disposed in the scanning direction.

Figure 14:
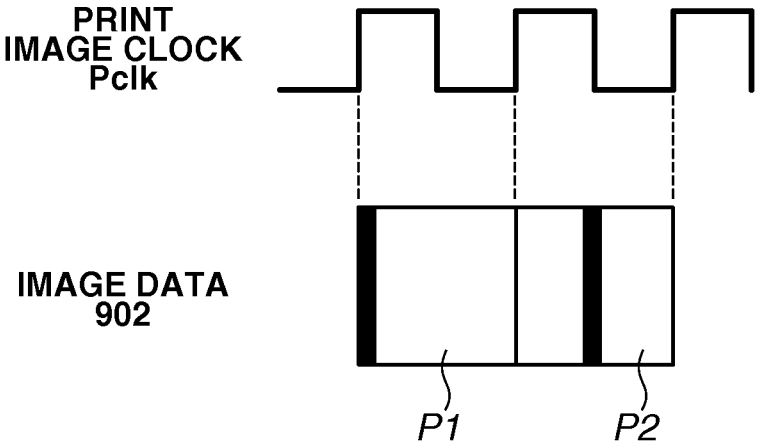
FIG. 14 illustrates a background exposure pattern.

In a first light-emission pattern, the first pixel P1 and the second pixel P 2 are differentiated in both the light-emission start timing and the light-emission termination timing relative to the reference point (i.e., the rise timing) of the image clock Pclk in each pixel. According to an example illustrated in FIG. 14, the scanner unit 210 emits light at the upstream side of the first pixel P1 in the scanning direction and then emits light at the center of the second pixel P2 in the scanning direction. The light-emission width (i.e., the light-emission period) is not different between the first pixel P1 and the second pixel P2.

Figure 15:
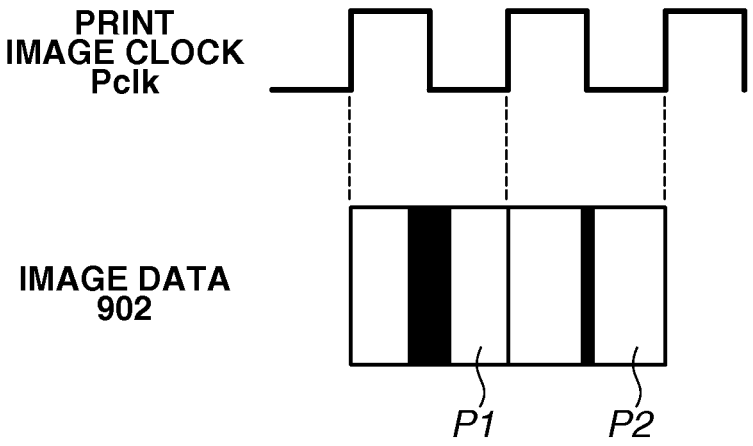
FIG. 15 illustrates a background exposure pattern.

In a second light-emission pattern, the first pixel P1 and the second pixel P2 are differentiated in the light-emission width (i.e., the light-emission period) in each pixel. According to an example illustrated in FIG. 15, the light-emission width (i.e., the light-emission period) of the first pixel P1 is longer than that of the second pixel P2. The maximum value of the light-emission width (i.e., the light-emission period) corresponds to an upper limit of the exposure amount which can lower the line-surface potential of the photosensitive drum in such a way as to prevent toner particles from adhering to the photosensitive drum at the level visible to human eyes (recognizable as a toner image).

The following relationships <1> to <3> are satisfied when Wh represents the width of one pixel, W1 represents the light-emission width of the first pixel, W2 represents the light-emission width of the second pixel, and Wmax (<Wh) represents the maximum light-emission width that does not cause any toner adhesion to be visible to human eyes.

$$W1 \neq W2 \quad <1>$$

$$W\max \geq W1 \quad <2>, \text{ and}$$

$$W\max \geq W2 \quad <3>$$

Further, if an appropriate light-emission width is comparable to approximately 10% of one pixel, satisfying the following relationship <4> is useful to obtain an appropriate light-emission pattern.

$$2Wh \times (10/100) \geq W1 + W2 \quad <4>$$

More specifically, an averaged light-emission width is reduced to 10%.

Figure 16:
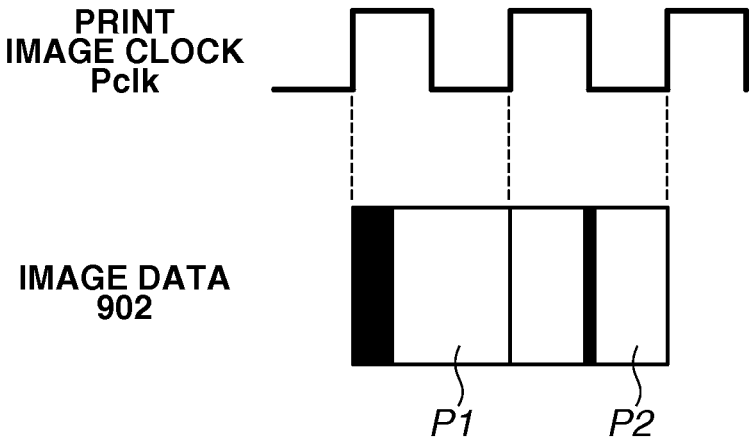
FIG. 16 illustrates a background exposure pattern.

The light-emission start timing relative to the reference point (i.e., the rise timing) of the image clock Pclk is not different between the first pixel P1 and the second pixel P2. A composite light-emission pattern obtainable by combining the above-described two light-emission patterns (i.e., the first light-emission pattern and the second light-emission pattern) is employable as another example of the background exposure pattern. According to an example illustrated in FIG. 16, the scanner unit 210 emits light with a longer light-emission width at the upstream side of the first pixel P1 in the scanning direction and further emits light with a light-emission width shorter than the light-emission width of the first pixel P1 at the center of the second pixel P2 in the scanning direction.

Next, the level-0 dither matrix is described in detail below. As mentioned above, the level-0 dither matrix according to the present exemplary embodiment corresponds to image data constituted by only the pixels to be subjected to the background exposure processing.

Figure 1A:
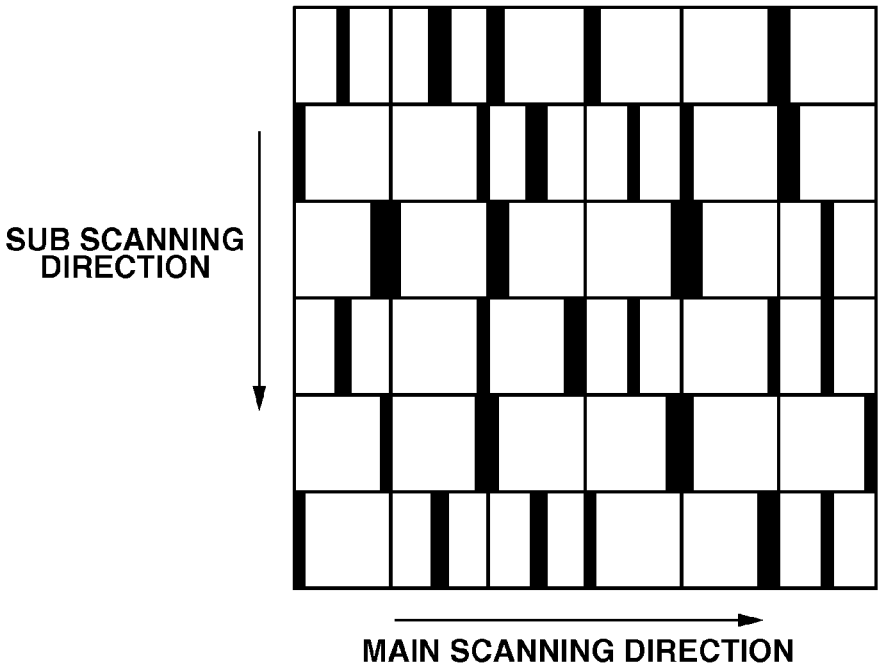
FIG. 1A illustrates a level-0 dither matrix.
Figure 1B:
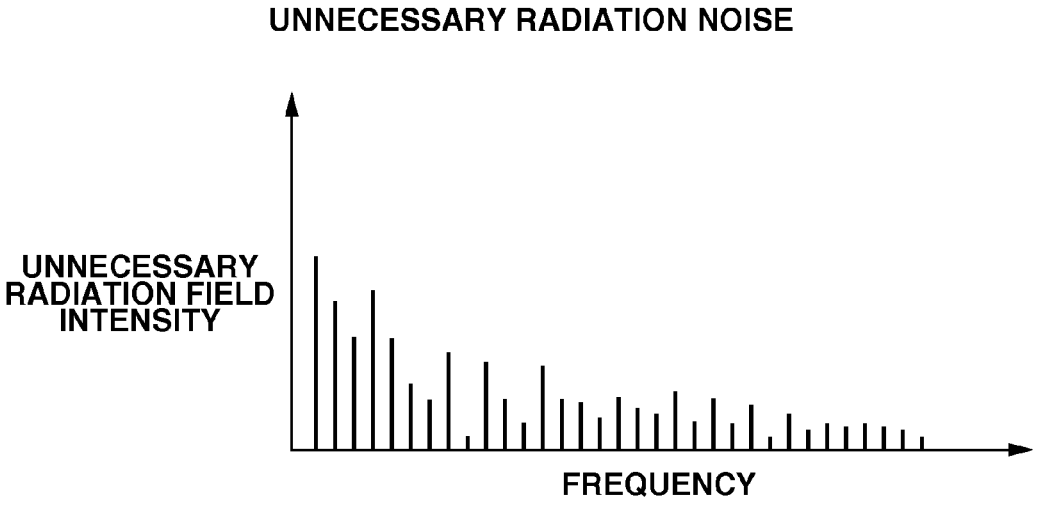
FIG. 1B illustrates unnecessary radiation noises.

FIG. 1A illustrates the level-0 dither matrix according to the present exemplary embodiment. FIG. 1B is a graph illustrating a frequency-intensity relationship about unnecessary radiation noises in a case where the dither matrix illustrated in FIG. 1A is used. The minimal dither matrix according to the present exemplary embodiment includes thirty-six pixels that form a square area composed of six pixels arrayed in the vertical direction and six pixels arrayed in the horizontal direction.

In the level-0 dither matrix, all of pixels neighboring each other in the scanning direction are constituted to have the first light-emission pattern, the second light-emission pattern, or the composite light-emission pattern obtainable by combining the first and second light-emission patterns. More specifically, according to the background exposure pattern that emits light based on the level-0 dither matrix, all of pixels neighboring each other in the scanning direction are differentiated in the light-emission start timing and/or light-emission termination timing of the exposure device.

Figure 20B:
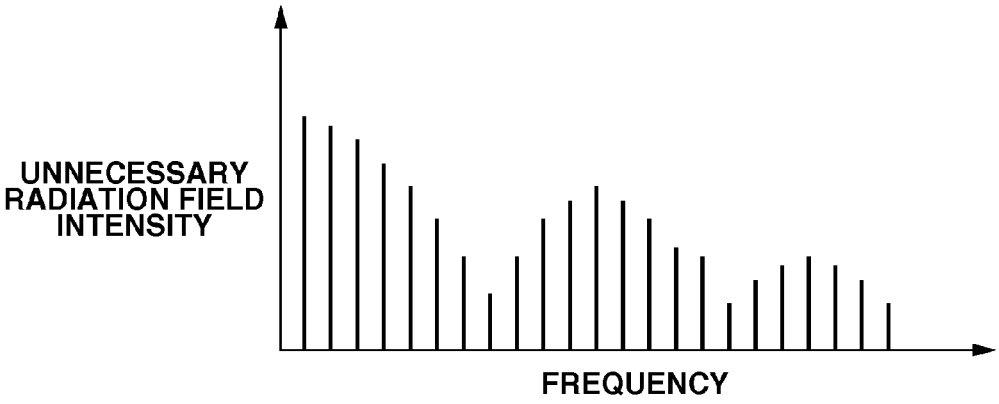
FIG. 20B illustrates unnecessary radiation noises.

FIG. 20A illustrates a level-0 dither matrix according to a comparative example. FIG. 20B is a graph illustrating a frequency-intensity relationship about unnecessary radiation noises in a case where the dither matrix illustrated in FIG. 20A is used. All pixels constituting the level-0 dither matrix according to the comparative example have the same light-emission width (i.e., the minute pulse width). Therefore, drive current flows repeatedly at a constant interval and in a minute time period in the laser driving circuit of the laser driving unit. Current flows in the laser driving circuit and the cable of the current supply power source line. A high-frequency noise voltage is periodically generated due to an inductance component of the line.

In this case, high-frequency noises included in the noise voltage induce resonance in the power source line cable because the generation of the noise voltage is periodical. The power source line cable serves as an antenna, which can spatially emit a part of electromagnetic energy of the high-frequency noises as electromagnetic waves. The electromagnetic waves generated in this manner are unnecessary radiations (noises). More specifically, the fundamental frequency is the image clock frequency (20 MHz in this case). The unnecessary radiation noises generated in this case have a multiplied frequency of 20 MHz.

On the other hand, when the dither matrix illustrated in FIG. 1A is used, drive current of minute time period flows non-periodically in the laser driving circuit of the laser driving unit. In this case, it is not likely that the drive current flows (is generated) repeatedly at a constant interval and in a minute time period. Therefore, preventing generation of the noise voltage at a specific period is feasible. More specifically, using the dither matrix illustrated in FIG. 1A is effective to prevent unnecessary radiation noises from occurring in a concentrated manner at a specific frequency (e.g., the multiplied frequency of 20 MHz when the image clock frequency is 20 MHz). Therefore, unnecessary radiation noise generating frequencies can be decentralized as illustrated in FIG. 1B. The peak value of unnecessary radiation noises can be lowered.

In the present exemplary embodiment, at least at a part of the level-0 dither matrix, pixels neighboring each other in the scanning direction are constituted by the first light-emission pattern, the second light-emission pattern, or the composite light-emission pattern obtainable by combining the first and second light-emission patterns. The above-mentioned configuration can lower the peak value of unnecessary radiation noises at the timing of scanning a portion constituted by the first light-emission pattern, the second light-emission pattern, or the composite light-emission pattern obtainable by combining the first and second light-emission patterns.

Further, the image forming apparatus according to the present exemplary embodiment stores the dither matrix including the background exposure light-emission pattern which can suppress the generation of unnecessary radiation noises and performs the multi-value dither processing. Therefore, the image forming apparatus according to the present exemplary embodiment can perform the background exposure processing in such a way as to suppress the generation of unnecessary radiation noises without providing a non-fixed frequency background exposure oriented clock generation circuit in addition to an image forming exposure oriented clock generation circuit.

As mentioned above, the image forming apparatus according to the present exemplary embodiment has a simple configuration that can lower the field intensity (i.e., the peak value) of electromagnetic waves generated as unnecessary radiations.

As mentioned above, the image forming apparatus according to the present exemplary embodiment is configured to generate the background exposure light-emission pattern when the image processing unit 204 performs the dither processing. However, the image forming apparatus according to the present exemplary embodiment can be modified in the following manner. More specifically, it is useful to provide a light-emission pattern generation unit in addition to the image processing unit 204. The light-emission pattern generation unit generates a background exposure light-emission pattern and superposes the generated pattern on the video signal in synchronization with the image clock Pclk. Then, the video signal on which the generated pattern is superposed is output to the laser driving circuit 210*a*.

Further, the additionally provided light-emission pattern generation unit generates a background exposure light-emission pattern in which the light-emission patterns of neighboring pixels are constituted by the first light-emission pattern, the second light-emission pattern, or the composite light-emission pattern obtainable by combining the first and second light-emission patterns. When the above-mentioned configuration is employed, similar effects can also be obtained without providing the non-fixed frequency background exposure oriented clock generation circuit in addition to the image forming exposure oriented clock generation circuit.

Next, an image forming apparatus according to a second exemplary embodiment is described in detail below. In the present exemplary embodiment, a third light-emission pattern is described in detail below as a modified embodiment of the second light-emission pattern described in the first exemplary embodiment. The rest of the configuration is similar to that described in the first exemplary embodiment. Therefore, similar portions and components are denoted by the same reference numerals and redundant description thereof will be avoided.

Figure 17:
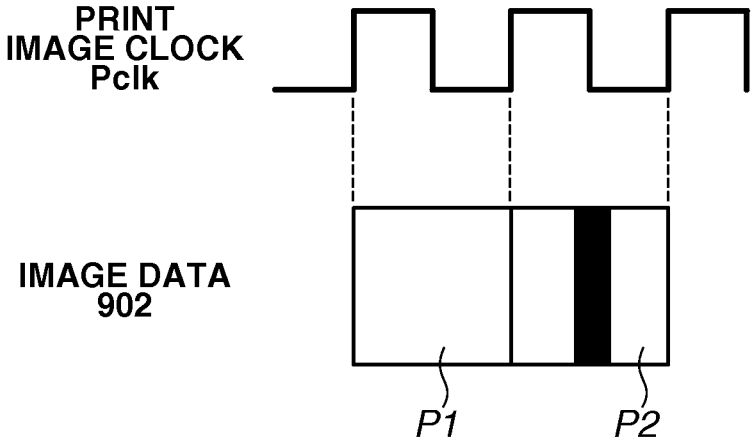
FIG. 17 illustrates a background exposure pattern.

A background exposure light-emission pattern which can lower the peak value of unnecessary radiation noises described in the present exemplary embodiment is the third light-emission pattern that does not cause either the first pixel P1 or the second pixel P2 to emit light. In an example illustrated in FIG. 17, the scanner unit 210 emits no light (light-emission width=0) for the first pixel P1 and emits light for the second pixel P2 to cause the second pixel P2 to serve as the minute exposure pixel. In this case, because the light emission is not performed for one of two pixels, the light-emission time width for the other pixel is set to be longer complementarily. The total exposure amount of the laser in the background exposure processing is equivalent to the exposure amount that lowers the surface potential of the photosensitive drum from VD' to VD.

More specifically, in a case where the light emission is not performed for the first pixel, the relationships <1> to <4> described in the first exemplary embodiment can be rewritten in the following manner.

$$W1=0, W2>0 \qquad \text{<1>'}$$

$$W\max \geq W1(=0) \qquad \text{<2>, and}$$

$$W\max \geq W2 \qquad \text{<3>}$$

Further, if an appropriate light-emission width is comparable to appropriately 10% of one pixel, satisfying the following relationship <4>' is useful to obtain an appropriate light-emission pattern.

$$2Wh \times (10/100) \geq W2 \qquad \text{<4>'}$$

The image forming apparatus uses the above-mentioned third light-emission pattern as a part of the level-0 dither matrix described in the first exemplary embodiment. More specifically, in the level-0 dither matrix, all of pixels neighboring each other in the scanning direction are constituted by the first light-emission pattern, the second light-emission pattern, or a composite light-emission pattern obtainable by combining the first and second light-emission patterns or the third light-emission pattern.

Figure 18A:
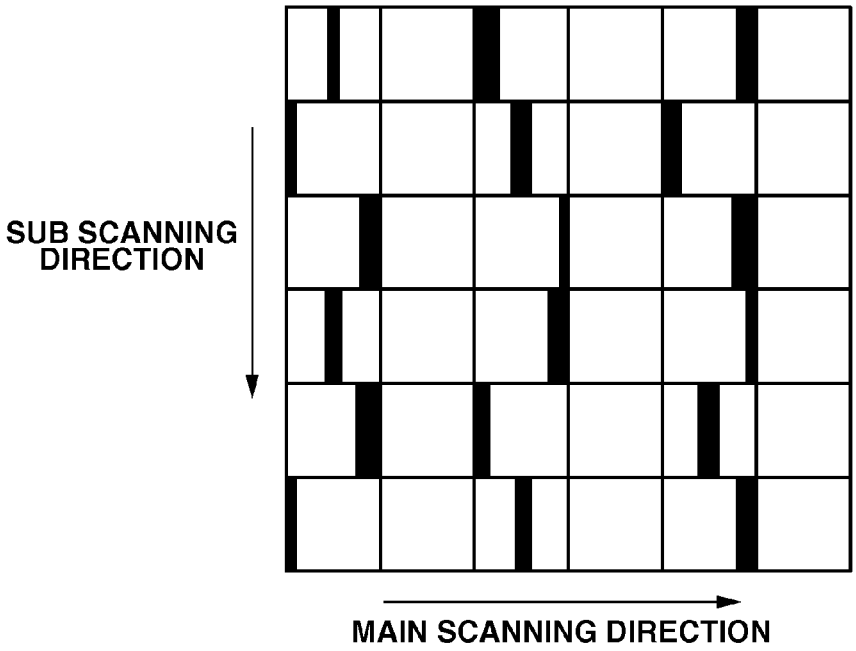
FIG. 18A illustrates a level-0 dither matrix.

As mentioned above, the image forming apparatus according to the present exemplary embodiment has a simple configuration that can lower the field intensity (i.e., the peak value) of electromagnetic wave generated as unnecessary radiations. FIG. 18A illustrates an example of the level-0 dither matrix usable to realize the above-mentioned third light-emission pattern.

Further, it is useful to constitute the level-0 dither matrix by using only the third light-emission patterns to obtain similar effects. More specifically, according to the conventional background exposure light-emission pattern illustrated in FIGS. 20A and 20B, unnecessary radiation noises having multiplied frequencies when the fundamental frequency is the image clock frequency are generated.

Figure 18B:
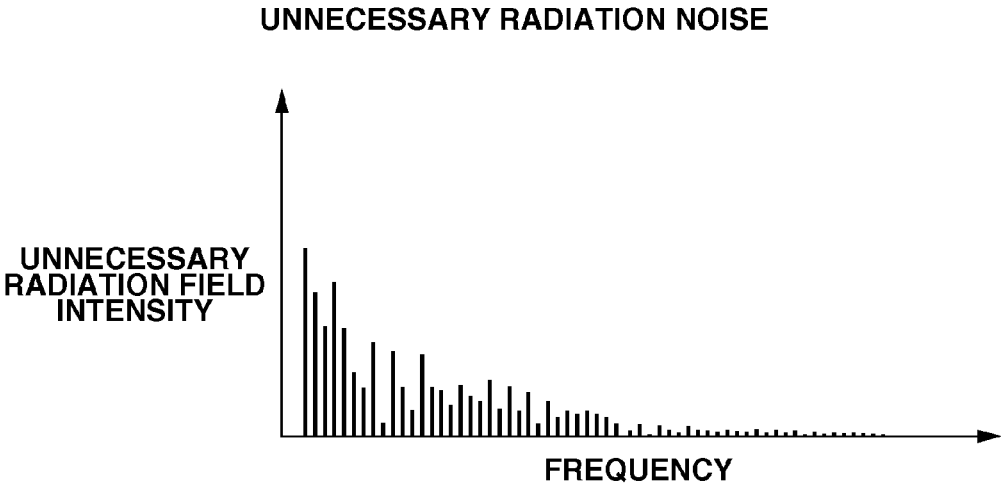
FIG. 18B illustrates unnecessary radiation noises.
Figure 19:
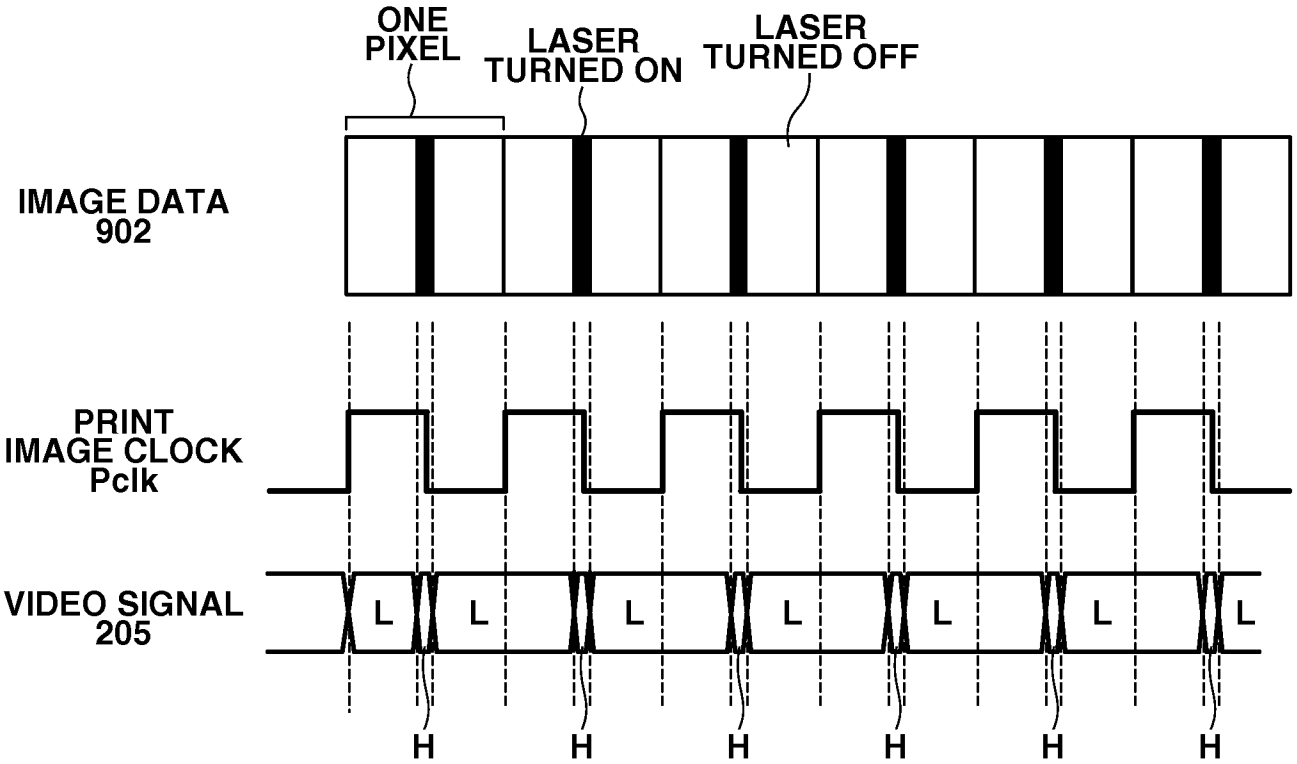
FIG. 19 illustrates a conventional background exposure pattern.

On the other hand, in the case where the level-0 dither matrix is constituted by using only the third light-emission patterns, the unnecessary radiation noise generating frequency shifts to a multiplied frequency comparable to a half of the image clock frequency, as illustrated in FIG. 18B. Therefore, it is feasible to suppress troublesome high-frequency unnecessary radiation noises.

In the case where the second pixel is designated as the pixel for which the light emission is performed in the third light-emission pattern, it is feasible to differentiate the light-emission width or the laser emission start timing and/or the laser emission termination timing relative to the image clock reference point between second pixels continuously disposed. In this case, similar to the first exemplary embodiment, unnecessary radiation noise generating frequencies can be decentralized. It becomes feasible to lower the peak value of unnecessary radiation noises.

Next, an image forming apparatus according to a third exemplary embodiment is described in detail below. Although the configuration which can reduce unnecessary radiation noises having multiplied frequencies when the fundamental frequency is the image clock frequency has been described in the first and second exemplary embodiments, a configuration according to the third exemplary embodiment is characterized by reducing unnecessary radiation noises having further lower frequencies as described in detail below.

More specifically, the image forming apparatus according to the third exemplary embodiment uses a fourth light-emission pattern. The rest of the configuration is similar to that described in the first exemplary embodiment. Therefore, similar portions and components are denoted by the same reference numerals and redundant description thereof will be avoided.

Figure 21:
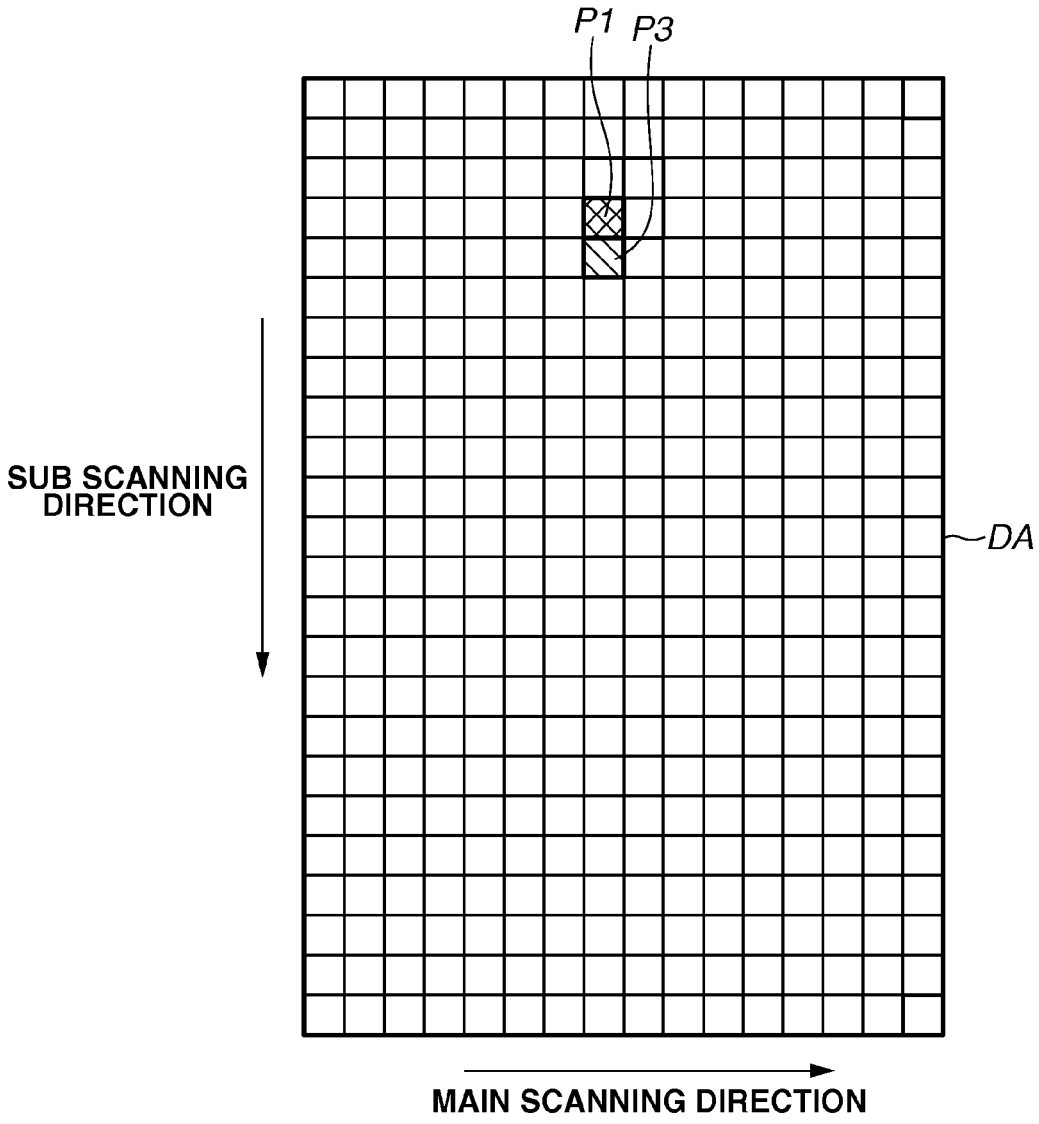
FIG. 21 illustrates pixels positioned outside a toner image non-forming area.

According to the fourth light-emission pattern, as illustrated in FIG. 21, a first pixel P1 and a second pixel P3 neighboring each other in the sub scanning direction in the toner image non-forming area DA are differentiated in the laser emission start timing or the laser emission termination timing relative to the reference point of the image clock Pclk or differentiated in the light-emission width.

More specifically, the first, the second, and the third light-emission patterns are applied to two pixels neighboring each other in the scanning direction (i.e., the main scanning direction) as described in the first and second exemplary embodiments. On the other hand, the fourth light-emission pattern is applied to two pixels neighboring each other in a direction perpendicular to the scanning direction (i.e. in the sub scanning direction).

Figure 22:
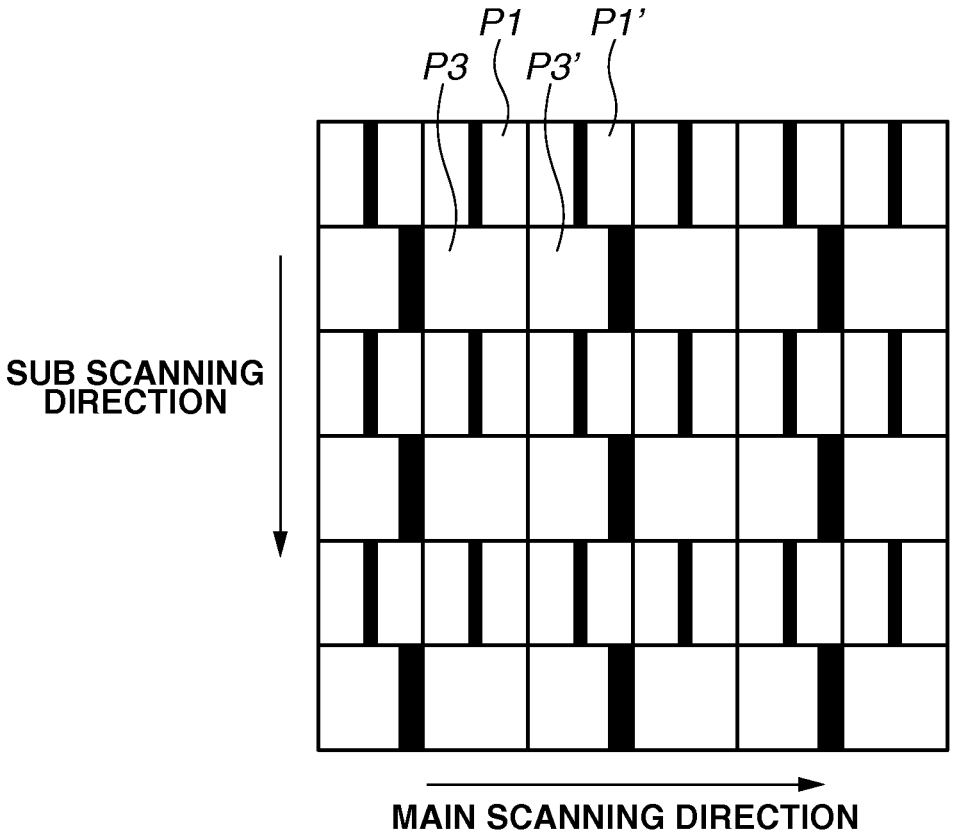
FIG. 22 illustrates a level-0 dither matrix.

In an example illustrated in FIG. 22, the scanner unit 210 emits light at the center of the first pixel P1 in the scanning direction and then emits no light for the second pixel P3. Further, the scanner unit 210 emits light at the center of another first pixel P1 ' in the scanning direction and emits light at the downstream side of another second pixel P3 ' in scanning direction. Further, the light-emission width of another second pixel P3 ' is longer than the light-emission width of another first pixel P1 '.

As mentioned above, the image forming apparatus according to the present exemplary embodiment uses the fourth light-emission pattern, which is similar to the first to third light-emission patterns in that the background exposure light-emission pattern does not become the same, for pixels adjacently disposed in the sub scanning direction. Thus, unnecessary radiation noises arising from the repetition of the minute time period drive current, which corresponds to a background exposure oriented light emission generating at one-line intervals in the sub scanning direction, can be decentralized and the peak value of unnecessary radiation noises can be lowered.

The fourth light-emission pattern can be employed together with the first to third light-emission patterns. In this case, unnecessary radiation noise generating frequencies can be decentralized. The peak value of unnecessary radiation noises can be lowered.

Next, an image forming apparatus according to a fourth exemplary embodiment is described in detail below. In the first to third exemplary embodiments, the exposure device causes the polygon mirror to deflect a laser beam and performs a scanning operation on the photosensitive drum with a laser beam spot. A so-called solid state exposure configuration according to the present exemplary embodiment includes a plurality of light sources disposed in the main scanning direction (i.e., the rotational axis direction of the photosensitive drum) that can cooperatively serve as an exposure device which can expose the photosensitive drum, as described in detail below.

The exposure device includes a plurality of light sources that can independently emit light, in which the number of light sources is equal to or greater than the number of pixels in the main scanning direction. The exposure device further includes an optical system (e.g., lenses) which can form an image with the light emitted from each light source in such a way as to form a plurality of beam spots on the photosensitive drum.

The plurality of beam spots being thus formed is arrayed in the main scanning direction on the photosensitive drum. The clearance of two beam spots is equivalent to the clearance of pixels in the main scanning direction.

While the photosensitive drum rotates, the plurality of beam spots arrayed in the main scanning direction moves in the sub scanning direction relative to the photosensitive drum surface. Through the above-mentioned processing, it is feasible to accomplish the scanning operation by irradiating a two-dimensional area extending in both the main scanning direction and the sub scanning direction with light on the surface of the photosensitive drum.

When the above-mentioned exposure device performs a scanning operation based on image data, the image processing unit generates a video signal composed of pixels of image data to be irradiated with light from respective light sources that are serially arrayed according to a light emission order, and outputs the generated video signal to the driving unit of respective light sources in synchronization with the image clock. In this case, the light emission order of respective light sources is the order advancing from upstream to downstream in the sub scanning direction.

Figure 24:
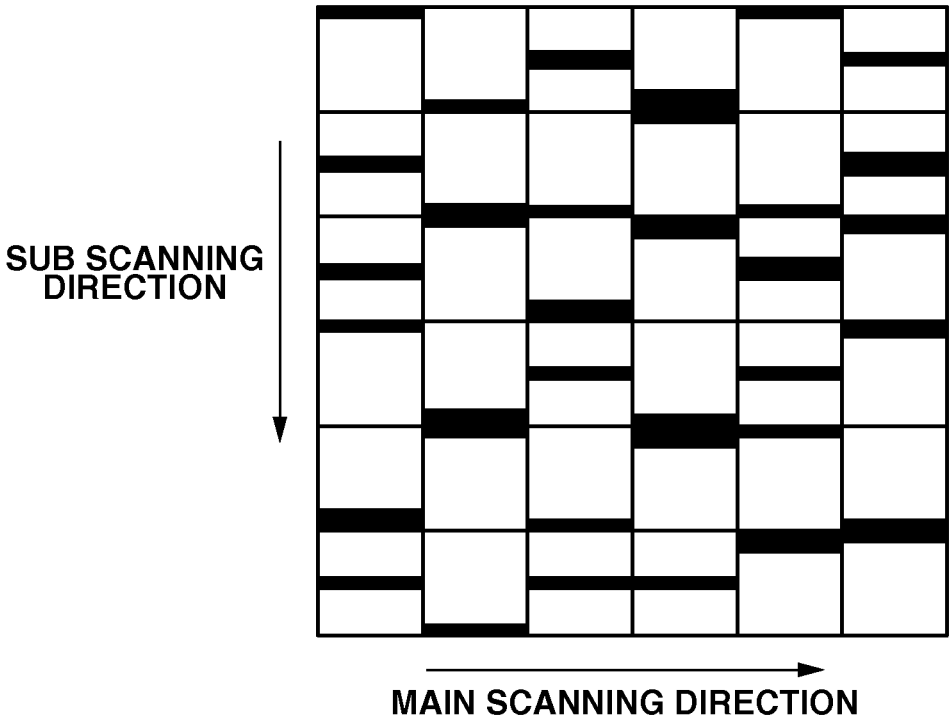
FIG. 24 illustrates a level-0 dither matrix.

In the present exemplary embodiment, unnecessary radiation noise generating frequencies can be decentralized in a case where white areas (i.e., the toner image non-forming areas) are continuously disposed in the sub scanning direction. More specifically, in a level-0 dither matrix illustrated in FIG. 24, all of pixels neighboring each other in the scanning direction are constituted by the first light-emission pattern, the second light-emission pattern, the third light-emission pattern, or the composite light-emission pattern obtainable by combining the first and second light-emission patterns. The scanning direction in the present exemplary embodiment is the sub scanning direction perpendicular to an array direction of the plurality of beam spots formed on the photosensitive drum surface.

As mentioned above, the image forming apparatus according to the present exemplary embodiment can decentralize unnecessary radiation noise generating frequencies and can lower the peak value of unnecessary radiation noises even in a case where the exposure device has a solid state exposure configuration.

Next, an image forming apparatus according to a fifth exemplary embodiment is described in detail below. Reducing unnecessary radiation noises that have arisen from the background exposure of a particular color has been described in the first to fourth exemplary embodiments. On the other hand, the image forming apparatus according to the present exemplary embodiment can prevent unnecessary radiation noises from increasing in a case where the background exposure is simultaneously performed for a plurality of colors, as described in detail below. The rest of the configuration is similar to that described in the first exemplary embodiment.

Therefore, similar portions and components are denoted by the same reference numerals and redundant description thereof will be avoided.

Figure 25:
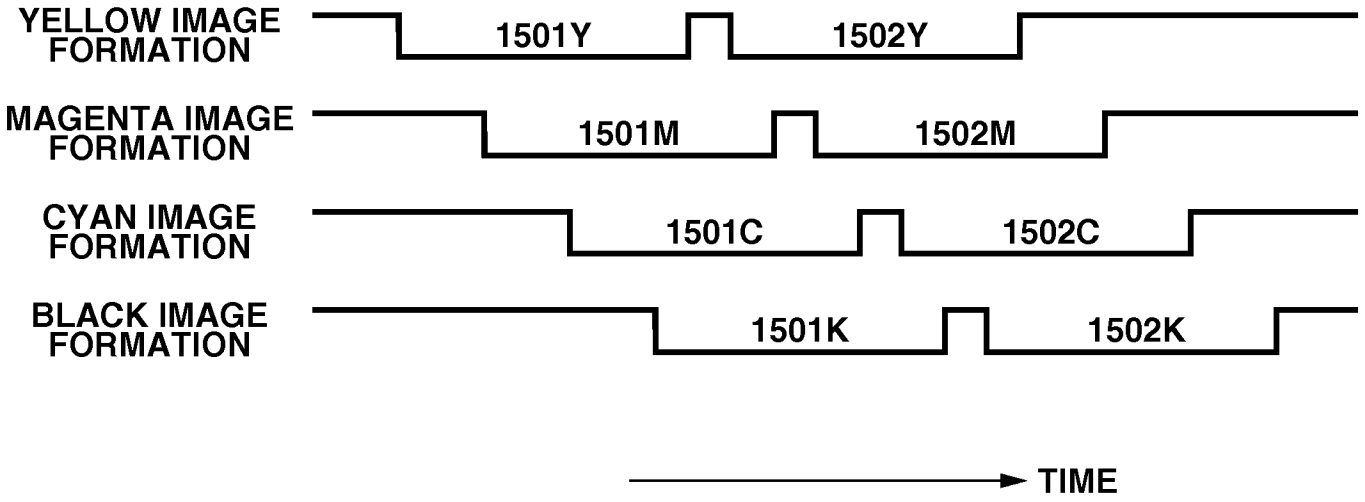
FIG. 25 illustrates laser emission timing.

FIG. 25 is a sequence diagram illustrating light-emission timing of each color laser in a case where the image forming apparatus performs continuous print operation. In the illustrated timing chart, each Low section indicates the laser emission timing for each color in an image printing operation. In an image printing operation for the first sheet, the image forming apparatus successively starts laser emission processing according to the timings of yellow image formation 1501Y, magenta image formation 1501M, cyan image formation 1501C, and black image formation 1501K.

In an image printing operation for the second sheet, the image forming apparatus successively performs laser emission processing according to the timings of yellow image formation 1502Y, magenta image formation 1502M, cyan image formation 1502C, and black image formation 1502K. Accordingly, there is a period during which a plurality of color laser diodes simultaneously emits light in an image printing operation. Further, there is a period during which a plurality of color laser diodes simultaneously emits light according to the light-emission pattern of the level-0 dither matrix depending on an image to be printed. In this case, the color laser beam printer 201 generates unnecessary radiation noises of respective colors which are summed up.

Figure 34A:
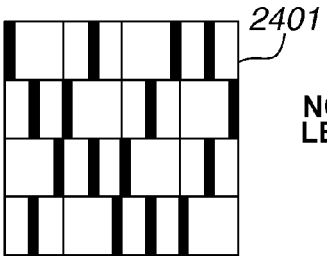
FIGS. 34A to 34H illustrate background exposure patterns in relation to radiation noises.
Figure 34E:
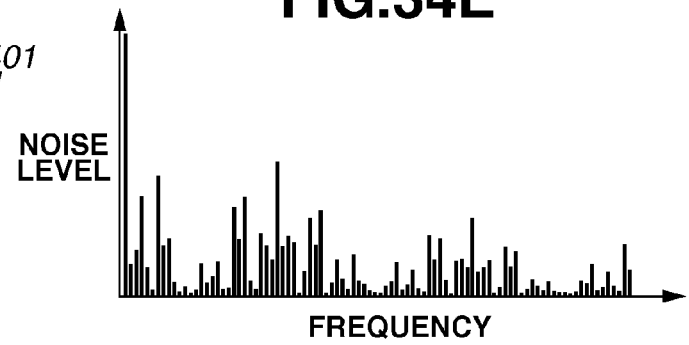
Figure 34B:
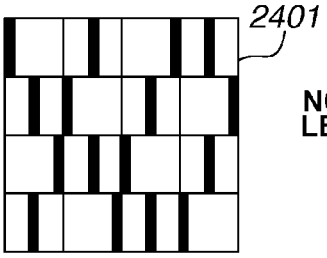
Figure 34F:
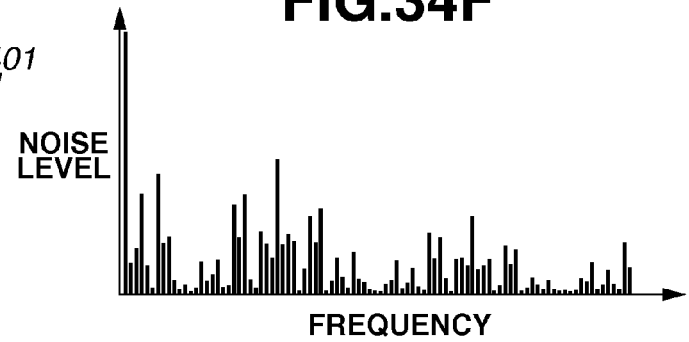
Figure 34C:
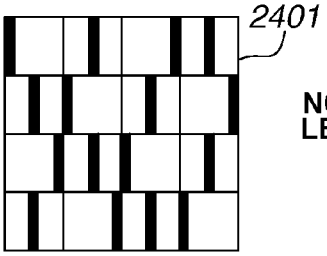
Figure 34G:
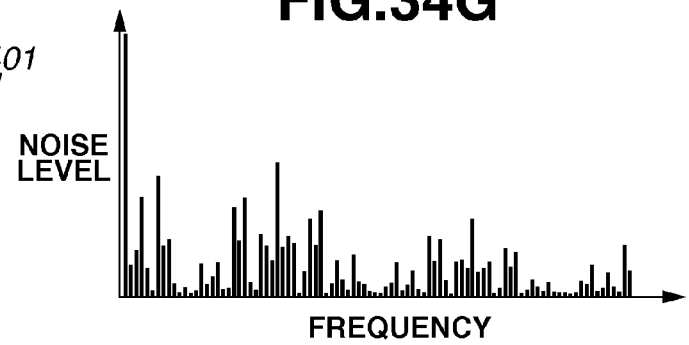
Figure 34D:
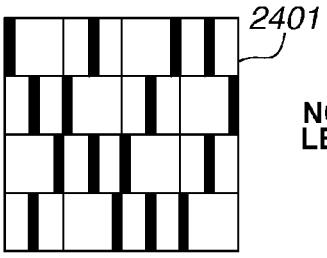
Figure 34H:
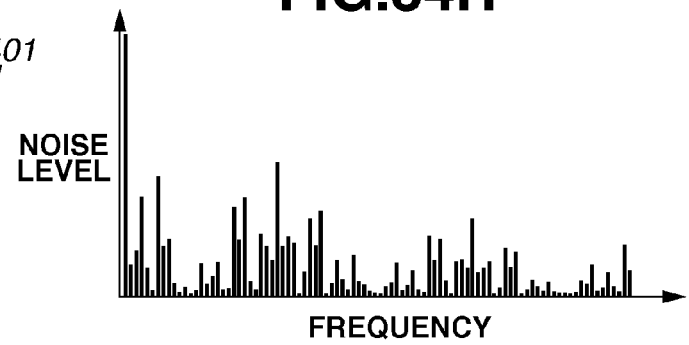

FIGS. 34A to 34H illustrate examples of the level-0 dither matrix of respective colors and graphs illustrating unnecessary radiation noises occurring when the light emission is performed based on the corresponding level-0 dither matrices. FIGS. 34A and 34E illustrate a level-0 dither matrix dedicated to yellow color and corresponding unnecessary radiation noises. FIGS. 34B and 34F illustrate a level-0 dither matrix dedicated to magenta color and corresponding unnecessary radiation noises. FIGS. 34C and 34G illustrate a level-0 dither matrix dedicated to cyan color and corresponding unnecessary radiation noises. FIGS. 34D and 34H illustrate a level-0 dither matrix dedicated to black color and corresponding unnecessary radiation noises.

In a case where the same level-0 dither matrix is applied to respective colors as illustrated in FIGS. 34A to 34D, unnecessary radiation noises generated by respective color laser driving circuits have the same frequency components. Therefore, even when unnecessary radiation noise generating frequencies can be decentralized using the method described in the first to fourth exemplary embodiments to lower the peak value of unnecessary radiation noises at respective frequencies for one color, the total peak value of unnecessary radiation noises of respective frequencies will be significantly large if the peak values of four colors are summed up.

Figure 26A:
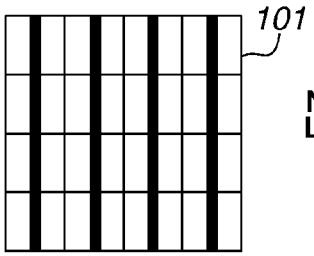
FIGS. 26A to 26H illustrate background exposure patterns in relation to unnecessary radiation noises.
Figure 26E:
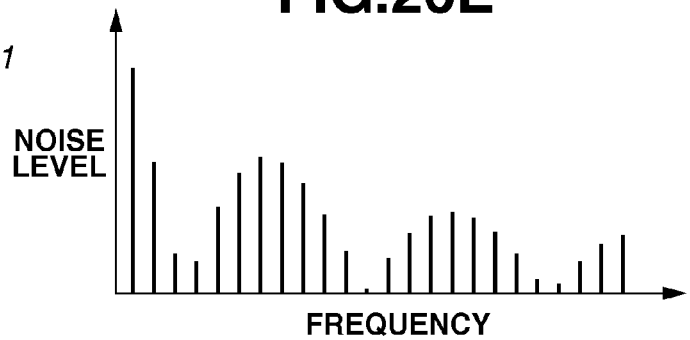
Figure 26B:
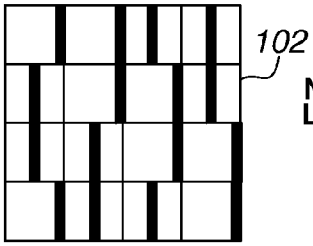
Figure 26F:
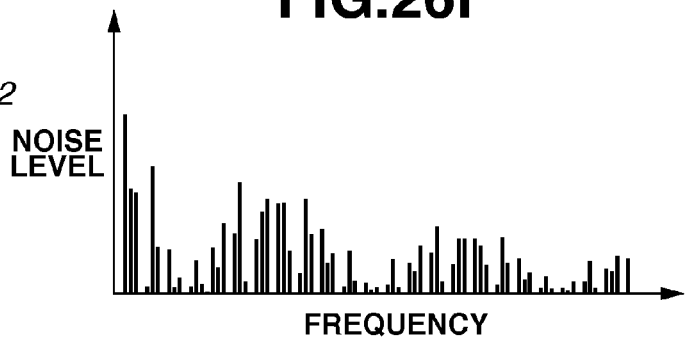
Figure 26C:
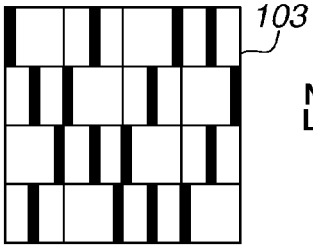
Figure 26G:
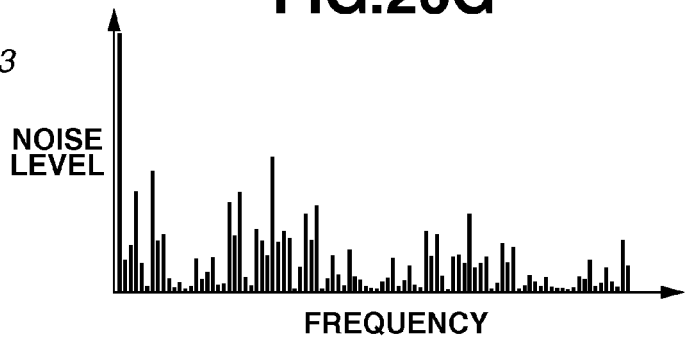
Figure 26D:
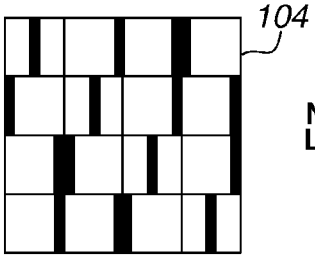

FIGS. 26A to 26D illustrate level-0 dither matrices corresponding to the background exposure patterns of respective colors according to the present exemplary embodiment. FIG. 26A illustrates a yellow image oriented level-0 dither matrix 101. FIG. 26B illustrates a magenta image oriented level-0 dither matrix 102. FIG. 26C illustrates a cyan image oriented level-0 dither matrix 103. FIG. 26D illustrates a black image oriented level-0 dither matrix 104.

Except for the yellow image oriented level-0 dither matrix 101, the level-0 dither matrix of each color is similar to that described in the first exemplary embodiment. More specifically, at least at a part of the level-0 dither matrix, pixels neighboring each other in the scanning direction are constituted by the first light-emission pattern, the second light-emission pattern, or the composite light-emission pattern obtainable by combining the first and second light-emission patterns.

According to the first light-emission pattern, the first pixel P1 and the second pixel P2 (i.e., two pixels adjacently disposed) are differentiated in both the light-emission start timing and the light-emission termination timing relative to the reference point of the image clock Pclk in each pixel, as described in the first exemplary embodiment. Further, according to the second light-emission pattern, the first pixel P1 and the second pixel P2 are differentiated in the light-emission width (i.e., the light-emission period) in each pixel.

In a case where the level of unnecessary radiation noises remains in an actual range because the background exposure is performed for only one color, it is feasible to set the level-0 dither matrix for a specific color (e.g., yellow in the present exemplary embodiment) to be similar to the conventional background exposure pattern. If further reducing the unnecessary radiation noises is required, it is useful to set the background exposure patterns (i.e., level-0 dither matrices) of all colors to be similar to the noise-reducible background exposure pattern described in the first exemplary embodiment.

The noise-reducible background exposure pattern is a light-emission pattern according to which, at least at a part thereof, pixels neighboring each other in the scanning direction are constituted by the first light-emission pattern, the second light-emission pattern, or the composite light-emission pattern obtainable by combining the first and second light-emission patterns.

Further, in the present exemplary embodiment, the level-0 dither matrices 101, 102, 103, and 104 of respective colors are mutually differentiated to decentralize the peak frequency of unnecessary radiation noises that are generated when the laser diode 211 of each color emits light based on the level-0 dither matrix of each color. More specifically, the level-0 dither matrices 101, 102, 103, and 104 of respective colors are set to be mutually different so that the light-emission pulse generation period is differentiated between respective colors or the light emissions can be prevented from simultaneously occurring.

Figure 26H:
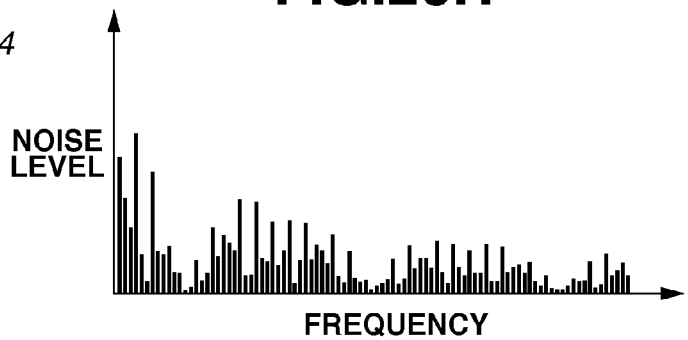

FIGS. 26E to 26H illustrate radiation noises that are generated when the laser diode 211 of each color emits light based on the level-0 dither matrix of each color. FIG. 26E illustrates radiation noises that have arisen from the level-0 dither matrix 101 in the yellow laser driving circuit. Similarly, FIG. 26F illustrates noises that have arisen from the level-0 dither matrix 102. FIG. 26G illustrates noises that have arisen from the level-0 dither matrix 103. FIG. 26H illustrates noises that have arisen from the level-0 dither matrix 104.

The unnecessary radiation noises generated by the background exposure are mainly influenced by the recurrence period of light-emission patterns disposed in the main scanning direction or the lighting/quenching period of each light-emission pattern. The level-0 dither matrices of yellow, magenta, cyan, and black colors are mutually differentiated in light-emission pattern. Therefore, even when unnecessary radiation noises generated when the background exposure processing is performed according to respective light-emission patterns are summed up (or combined), the frequency of finally generated noises or the peak noise level can be decentralized.

Figure 27:
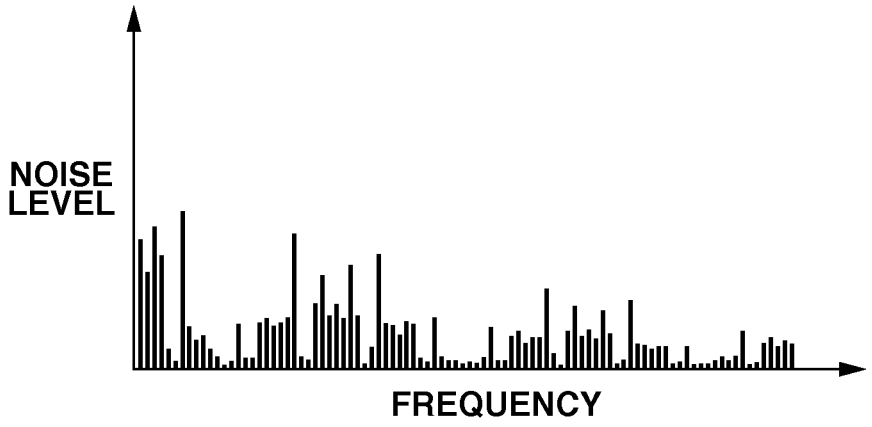
FIG. 27 illustrates radiation noises.

FIG. 27 illustrates unnecessary radiation noises that have been generated by the image forming apparatus during a printing operation, which represents a combination of unnecessary radiation noises arising from the level-0 dither matrices of respective color laser driving circuits. More specifically, the image forming apparatus generates composite noises composed of the unnecessary radiation noises of background exposure pattern light-emissions of respective colors illustrated in FIGS. 26E to 26H, arising from the level-0 dither matrices of respective colors.

In this case, the level-0 dither matrices 101, 102, 103, and 104 of respective colors are set beforehand in such a way as to prevent an undesirable overlap of the frequencies of unnecessary radiation noises generated when respective laser diodes 211 emit light based on these dither matrices. Therefore, it is feasible to decentralize the peak noise level and reduce the unnecessary radiation noises generated by the image forming apparatus in an image print operation.

In the present exemplary embodiment, the dither matrix of each color has a 4×4 (=16) pixel size composed of four pixels arrayed in the main scanning direction and four pixels arrayed in the sub scanning direction. However, the size of the dither matrix is not limited to the above-mentioned example. Further, the dither matrices of respective colors can be differentiated in size. For example, it is useful to apply the size of 4×4 pixels to a yellow dither matrix, 8×6 pixels to a magenta dither matrix, 3×2 pixels to a cyan dither matrix, and 10×12 pixels to a black dither matrix.

As mentioned above, according to the present exemplary embodiment, the background exposure light-emission pattern (i.e., the level-0 dither matrix) is differentiated for each color. Therefore, it is feasible to reduce the field intensity (i.e., the peak value) of electromagnetic waves generated as unnecessary radiations when the image forming apparatus performs a color image forming operation.

Next, an image forming apparatus according to a sixth exemplary embodiment is described in detail below. In the first exemplary embodiment, the laser diode 211 emits two laser beams simultaneously to perform expose processing by irradiating one photosensitive drum with light. The present exemplary embodiment provides a configuration which can prevent unnecessary radiation noises from increasing when the image forming apparatus performs the background exposure processing in a case where the laser diode 211 emits two laser beams simultaneously in such a way as to irradiate one photosensitive drum with light. The rest of the configuration is similar to that described in the first exemplary embodiment. Therefore, similar portions and components are denoted by the same reference numerals and redundant description thereof will be avoided.

[Laser Light-Emission Control]

A configuration of a laser emission device according to the present exemplary embodiment is described in detail below. The laser diode 211 of the scanner unit 210 illustrated in FIG. 2 includes four light source units (e.g., semiconductor lasers although not illustrated) 211*y*, 211*m*, 211*c*, and 211*k*. In the present exemplary embodiment, each light source unit is configured to have two light-emission points (light sources). The light source units 211*y*, 211*m*, 211*c*, and 211*k* are similar to each other in configuration. Therefore, the light source unit 211*y* is mainly described in detail below.

Figure 28:
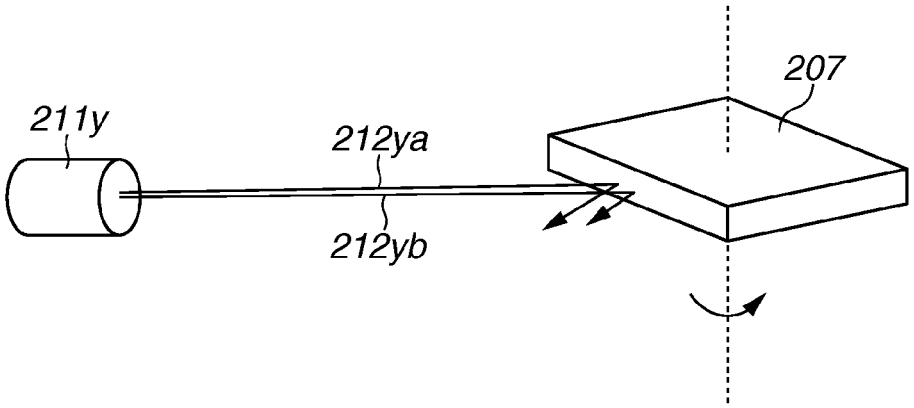
FIG. 28 is a schematic perspective view illustrating a relationship between a light source unit and a polygon mirror.

FIG. 28 is a schematic perspective view illustrating a relationship between the light source unit 211*y* and the polygon mirror 207, although no lens is illustrated for the purpose of simplifying the drawing. The single light source unit 211*y* emits a plurality of laser beams (i.e., first laser beam 212*ya* and second laser beam 212*yb*) each being independently controllable. The first laser beam 212*ya* can be emitted based on the video signal 205 dedicated to the first laser beam 212*ya*, which is output from the image processing unit 204. The second laser beam 212*yb* can be emitted based on the video signal 205 dedicated to the second laser beam 212*yb*, which is output from the image processing unit 204. In the present exemplary embodiment, one light source unit is configured to emit two laser beams that are independently controllable in light emission. However, it is useful to configure the light source unit to emit three or more laser beams that are independently controllable in light emission.

Figure 29:
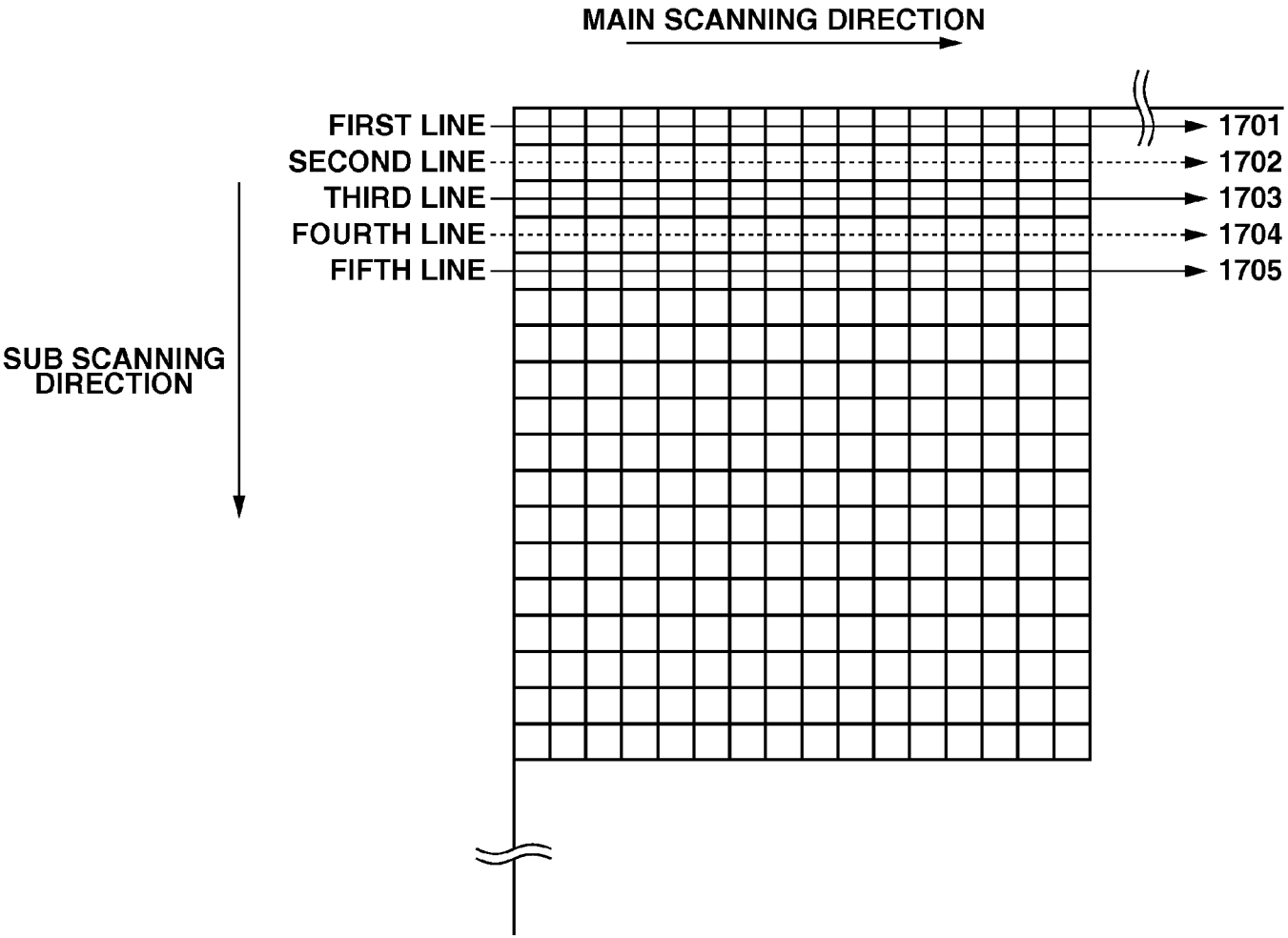
FIG. 29 illustrates a laser scanning operation.

Next, a laser emission control applicable to image data generated by a print image generation unit is described in detail below. FIG. 29 illustrates a part of image data generated by the image processing unit 204. The first laser beam and the second laser beam can form two laser beam spots (images) being offset at least in the sub scanning direction on the photosensitive drum 215. The respective laser beam spots can simultaneously move in the main scanning direction according to the rotation of the polygon mirror 207. More specifically, the first laser beam and the second laser beam are usable to form two scanning lines through the scanning using only one surface of the polygon mirror 207.

To this end, in the image data illustrated in FIG. 29, a scanning line corresponding to a first laser beam and a scanning line corresponding to a second laser beam are alternately disposed in the sub scanning direction. More specifically, the image forming apparatus scans image data of a first line 1701 with the first laser beam and then scans image data of a second line 1702 with the second laser beam. Similarly, the image forming apparatus scans image data of a third line 1703 with the first laser beam and then scans image data of a fourth line 1704 with the second laser beam, and further scans image data of a fifth line 1705 with the first laser beam. In this manner, the image forming apparatus performs scanning processing alternately using the first and second laser beams to form a latent image on the drum surface based on the image data.

The image processing unit 204 generates a first laser beam oriented video signal 205 and a second laser beam oriented video signal 205 based on image data according to the above-mentioned relationship. The image processing unit 204 transmits the first laser beam oriented video signal 205 and the second laser beam oriented video signal 205 to the laser driving unit 210*a* via the image forming control unit 206. The laser driving unit 210*a* causes the light source unit 211*y* to emit light at two light-emission points thereof based on the first laser beam oriented video signal 205 and the second laser beam oriented video signal 205.

Figure 30A:
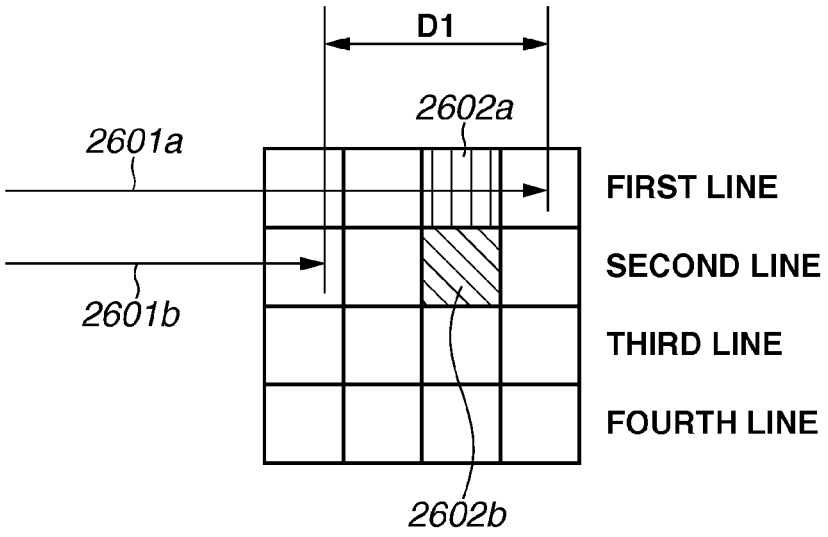
FIGS. 30A and 30B illustrate image data in relation to laser emission timing.
Figure 30B:
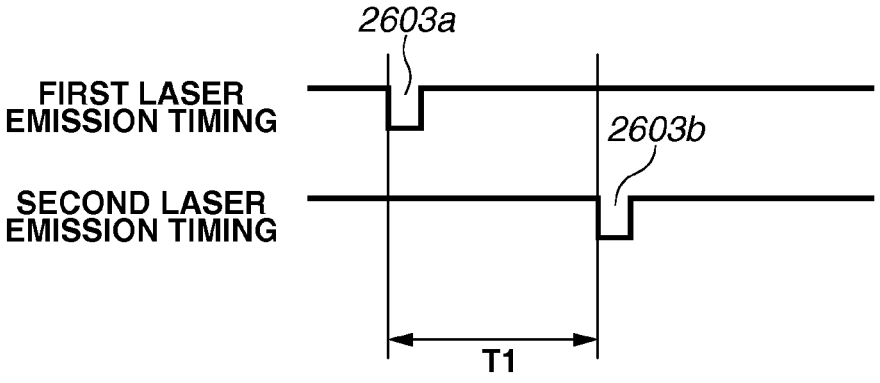

FIGS. 30A and 30B illustrate image data and laser emission timing. In the present exemplary embodiment, the spots (i.e., the images) of the first laser beam and the second laser beam formed on the photosensitive drum 215 at the same timing are offset not only in the sub scanning direction but also in the main scanning direction. Therefore, as illustrated in FIG. 30A, while the scanning is performed in the main scanning direction, scanning 2601*b* by the second laser beam is positioned distance D1 from the upstream side of scanning 2601*a* by the first laser beam.

In other words, the second laser beam spot is positioned the distance D1 from the upstream side of the first laser beam spot in the main scanning direction. Even when the illustrated image data includes two pixels 2602*a* and 2602*b* that are adjacently disposed in the sub scanning direction, the light-emission timing of the first laser beam based on the data of pixel 2602*a* is not identical to the light-emission timing of the second laser beam based on the data of pixel 2602*b*.

FIG. 30B is a timing chart illustrating a light-emittable period 2603*a* of the first laser beam based on the data of pixel 2602*a* and a light-emittable period 2603*b* of the second laser beam based on the data of pixel 2602*b*. As mentioned above, the light-emission timing of the second laser beam based on the data of pixel 2602*b* is delayed by time T1 compared to the light-emission timing of the first laser beam based on the data of pixel 2602*a*.

Figure 31:
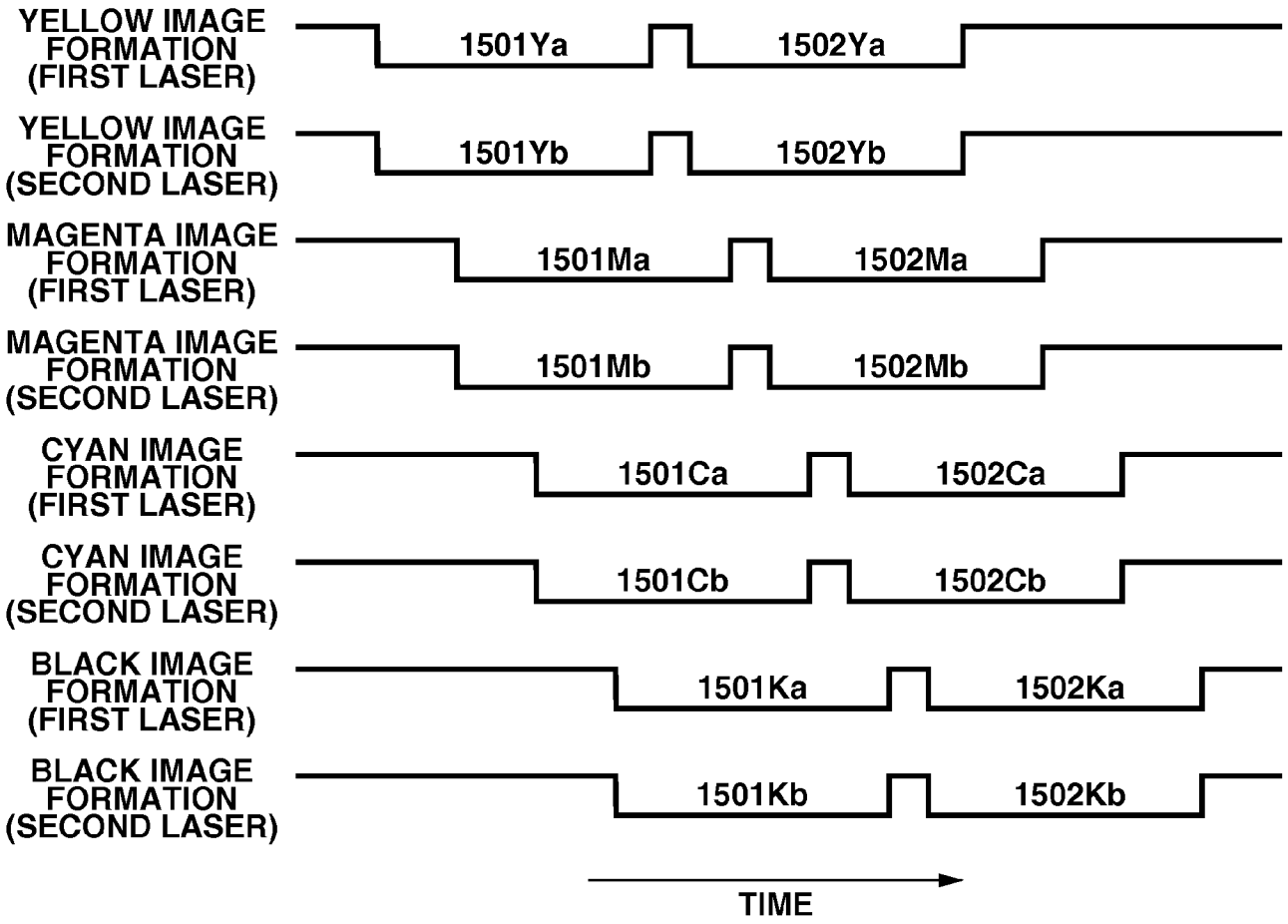
FIG. 31 illustrates laser emission timing.

A light-emission timing of each color laser in a case where the image forming apparatus performs a continuous printing operation is described in detail below with reference to FIG. 31. In the timing chart illustrated in FIG. 31, each Low section indicates the laser emission timing for each color in an image printing operation. In a color image forming operation, the image forming apparatus successively performs yellow image formations 1501Ya and 1501Yb, magenta image formations 1501Ma and 1501Mb, cyan image formations 1501Ca and 1501Cb, and black image formations 1501Ka and 1501Kb. In the image forming periods of respective colors, the light source units 211*y*, 211*m*, 211*c*, and 211*k* scan the photosensitive drum with two laser beams. Similarly, in a color image forming operation for the following sheet, the image forming apparatus successively performs yellow image formations 1502Ya and 1502Yb, magenta image formations 1502Ma and 1502Mb, cyan image formations 1502Ca and 1502Cb, and black image formations 1502Ka and 1502Kb.

[Background Exposure Oriented Laser Light-Emission Control]

Figure 32A:
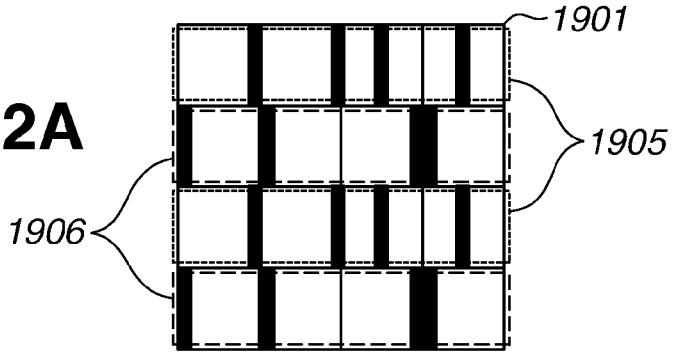
FIGS. 32A to 32D illustrate background exposure patterns.
Figure 32B:
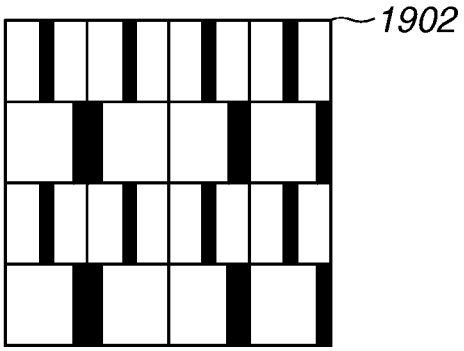
Figure 32C:
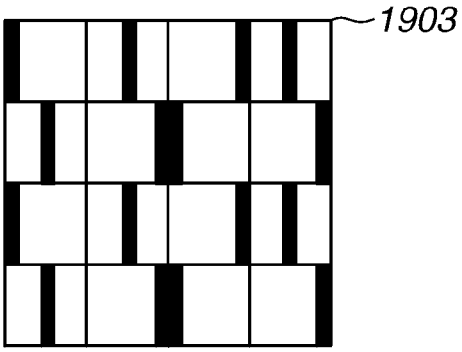
Figure 32D:
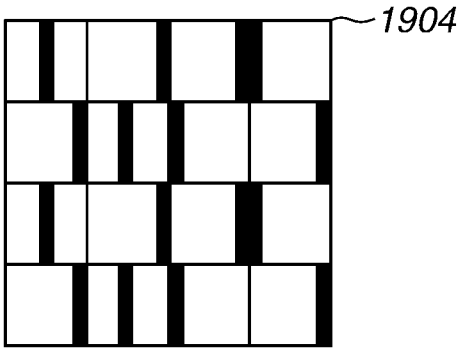

FIGS. 32A to 32D illustrate light-emission patterns that are usable for the background exposure of each color. A yellow pattern 1901 illustrated in FIG. 32A is a level-0 dither matrix dedicated to a yellow image. A magenta pattern 1902 illustrated in FIG. 32B is a level-0 dither matrix dedicated to a magenta image. A cyan pattern 1903 illustrated in FIG. 32C is a level-0 dither matrix dedicated to a cyan image. And, a black pattern 1904 illustrated in FIG. 32D is a background exposure pattern dedicated to a black image.

The yellow pattern 1901 is composed of first laser emission patterns 1905 and second laser emission patterns 1906. The first laser emission pattern 1905 and the second laser emission pattern 1906 are similar to the light-emission patterns described in the first exemplary embodiment. More specifically, at least at a part of the laser emission pattern, pixels neighboring each other in the scanning direction are constituted by the first light-emission pattern, the second light-emission pattern, or the composite light-emission pattern obtainable by combining the first and second light-emission patterns.

According to the first light-emission pattern, the first pixel P1 and the second pixel P2 (i.e., two pixels adjacent disposed) are differentiated in both the light-emission start timing and the light-emission termination timing relative to the reference point of the image clock Pclk in each pixel, as described in the first exemplary embodiment. Further, according to the second light-emission pattern, the first pixel P1 and the second pixel P2 are differentiated in the light-emission width (i.e., the light-emission period) in each pixel.

Further, in the present exemplary embodiment, the first laser emission pattern 1905 and the second laser emission pattern 1906 are set to be different from each other in light-emission property in such a way as to decentralize the peak frequency of unnecessary radiation noises. More specifically, setting of the level-0 dither matrices according to the present exemplary embodiment is characterized by differentiating the light-emission pulse generation period of the first laser beam from that of the second laser beam.

Further, the distance D1 between the first laser beam spot and the second laser beam spot in the scanning direction is taken into consideration in setting the level-0 dither matrices in such a way as to prevent the first laser emission and the second laser emission from occurring simultaneously. The magenta, cyan, and black patterns 1902, 1903, and 1904 are similar to the yellow pattern 1901. Further, similar to the fifth exemplary embodiment, background exposure light-emission patterns of respective colors are mutually different.

Figure 33A:
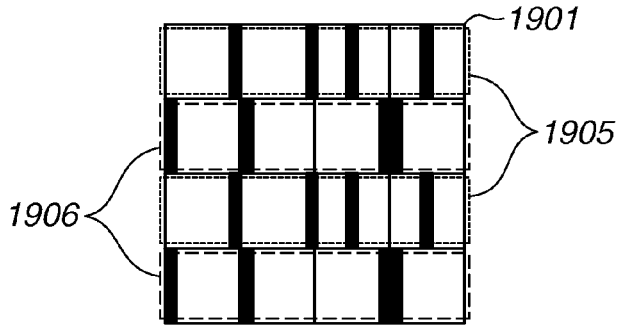
FIGS. 33A to 33D illustrate a background exposure pattern in relation to radiation noises.
Figure 33B:
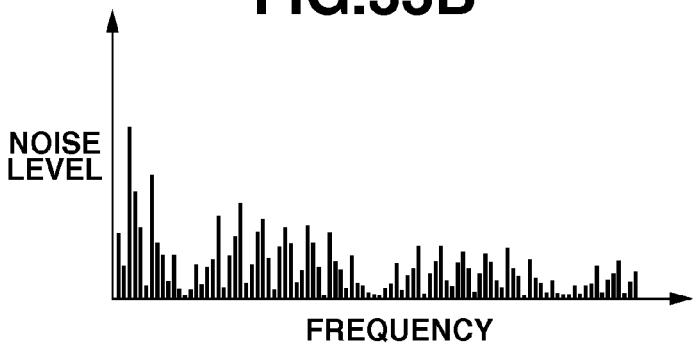
Figure 33C:
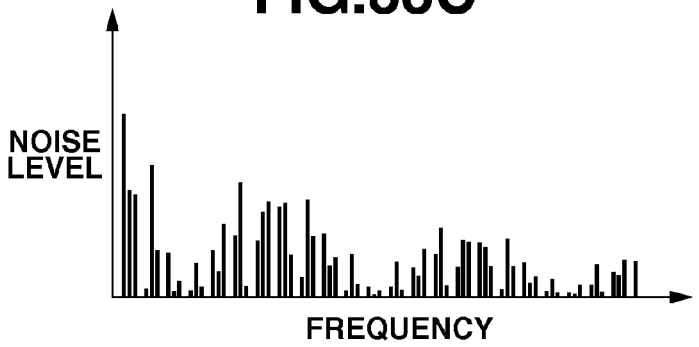
Figure 33D:
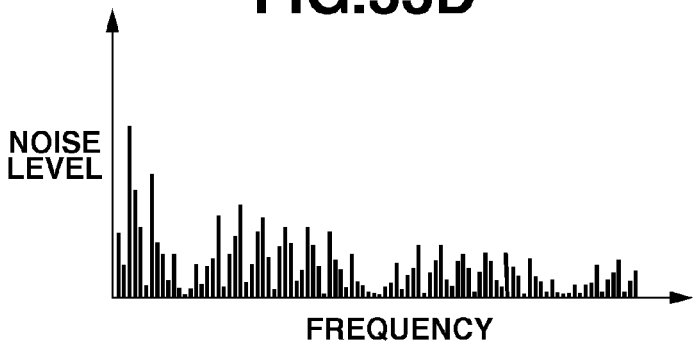

FIGS. 33A to 33D illustrate unnecessary radiation noises occurring when the laser diode 211 emits light according to the light-emission pattern 1901. FIG. 33A illustrates the yellow pattern 1901. FIG. 33D illustrates unnecessary radiation noises generated in this case. The unnecessary radiation noises illustrated in FIG. 33D are composite noises obtainable by combining unnecessary radiation noises deriving from the first laser emission pattern 1905 illustrated in FIG. 33B and unnecessary radiation noises deriving from the second laser emission pattern 1906 illustrated in FIG. 33C. The unnecessary radiation noises arising from the first laser emission pattern and the unnecessary radiation noises arising from the second laser emission pattern are different in the frequency characteristics and the peak level. As a result, the noise level of the composite noises can be reduced entirely.

Background exposure oriented light-emission patterns of other colors are similar to the above-mentioned example. As illustrated in FIGS. 32A to 32D, the light-emission patterns for the background exposure of respective colors are differentiated from each other. Further, in each color, the light-emission pattern for the background exposure is differentiated between the first laser and the second laser. As a result, the peak noise level can be decentralized. It is feasible to selectively reduce unnecessary radiation noises having specific frequencies that may occur when the image forming apparatus performs an image print operation.

Further, the first laser oriented light-emission pattern and the second laser oriented light-emission pattern are mutually differentiated in such a way as to prevent the first laser mission and the second laser mission from occurring simultaneously. Therefore, the peak current flowing in the laser driving circuit can be reduced and unnecessary radiation noises can be reduced.

As mentioned above, according to the present exemplary embodiment, the first laser oriented background exposure pattern is differentiated form the second laser oriented background exposure pattern. Accordingly, even when the image forming apparatus is configured to form a latent image on one photosensitive drum with a plurality of laser beams, the field intensity (i.e., the peak value) of electromagnetic waves generated as unnecessary radiations can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-227194 filed Oct. 31, 2013, which is hereby incorporated by reference herein in its entirety.

What is claimed is:

1. An image forming apparatus that can perform image forming processing by forming a latent image on a charged photosensitive member and causing toner particles to adhere to the latent image, the image forming apparatus comprising:

a light irradiation unit configured to emit light based on a light-emission signal corresponding to an image to be formed and form a latent image by irradiating and scanning the charged photosensitive member with light; and a signal generation unit configured to store information relating to a plurality of light-emission patterns having been set beforehand in accordance with a plurality of density levels of toner particles to be supplied to the photosensitive member, and configured to generate a plurality of light-emission signals based on the information relating to the plurality of light-emission patterns, wherein the signal generation unit is configured to generate the plurality of light-emission signals corresponding to a plurality of pixels that constitutes the image based on information relating to the light-emission patterns, wherein the signal generation unit is configured to store information relating to a toner non-adherent area oriented light-emission pattern having been set beforehand according to a level that does not cause toner particles to adhere to the photosensitive member, and generate a toner non-adherent area oriented light-emission signal based on information relating to the toner non-adherent area oriented light-emission pattern, wherein the toner non-adherent area oriented light-emission signal is at least one of the plurality of light-emission signals generated based on information relating to the plurality of light-emission patterns, and wherein while the light irradiation unit scans based on the toner non-adherent area oriented light-emission signal, when the light irradiation unit scans a portion corresponding to two pixels adjacently disposed in a scanning direction, at least one of (a) light-emission start timing of the light irradiation unit and (b) light-emission termination timing of the light irradiation unit is differentiated between the two pixels.

2. The image forming apparatus according to claim 1, wherein while the light irradiation unit scans based on the toner non-adherent area oriented light-emission signal, when the light irradiation unit scans a portion corresponding to two pixels adjacently disposed in the scanning direction, a time interval between the light-emission start timing and the light-emission termination timing of the light irradiation unit is kept the same and the light-emission start timing of the light irradiation unit is differentiated between the two pixels.

3. The image forming apparatus according to claim 1, wherein while the light irradiation unit scans based on the toner non-adherent area oriented light-emission signal, when the light irradiation unit scans a portion corresponding to two pixels adjacently disposed in the scanning direction, a time interval between the light-emission start timing and the light-emission termination timing of the light irradiation unit is differentiated between the two pixels.

4. The image forming apparatus according to claim 1, wherein while the light irradiation unit scans based on the toner non-adherent area oriented light-emission signal, when the light irradiation unit scans a portion corresponding to two pixels adjacently disposed in the scanning direction, the light irradiation unit does not emit light for a portion corresponding to one of the two pixels.

5. The image forming apparatus according to claim 1, wherein the light irradiation unit includes a deflection unit configured to move an irradiated light spot on a surface of the photosensitive member, and the scanning direction is a direction corresponding to a moving direction of the light spot moved by the deflection unit.

6. The image forming apparatus according to claim 1, wherein while the light irradiation unit scans based on the toner non-adherent area oriented light-emission signal, when the light irradiation unit scans a portion corresponding to two pixels adjacently disposed in a direction perpendicular to the scanning direction, at least one of (a) light-emission start timing of the light irradiation unit and (b) light-emission termination timing of the light irradiation unit is differentiated between the two pixels.

7. The image forming apparatus according to claim 6, wherein while the light irradiation unit scans based on the toner non-adherent area oriented light-emission signal, when the light irradiation unit scans a portion corresponding to two pixels adjacently disposed in a direction perpendicular to the scanning direction, the light irradiation unit does not emit light for a portion corresponding to one of the two pixels.

8. The image forming apparatus according to claim 1, wherein the light irradiation unit is configured to perform scanning by irradiating a plurality of charged photosensitive members with light, wherein the signal generation unit is configured to store information relating to a plurality of toner non-adherent area oriented light-emission patterns that corresponds to the plurality of photosensitive members, and the plurality of toner non-adherent area oriented light-emission patterns are mutually different light-emission patterns.

9. The image forming apparatus according to claim 1, wherein the light irradiation unit includes a plurality of light sources that irradiates one photosensitive member with light, and the signal generation unit is configured to generate a plurality of light-emission signals to cause the plurality of light sources to emit light, wherein the toner non-adherent area oriented light-emission patterns include a plurality of light-emission patterns corresponding to the plurality of light-emission signals, and the plurality of light-emission patterns are mutually different light-emission patterns.

10. The image forming apparatus according to claim 1, wherein the signal generation unit is configured to receive print data corresponding to the image to be formed and generate the light-emission signal for each coordinate of the print data in such a way as to provide the light-emission pattern corresponding to a density level of each coordinate, from among the plurality of light-emission patterns having been set beforehand.

11. The image forming apparatus according to claim 1, wherein the signal generation unit is configured to output the light-emission pattern in synchronization with a clock signal.

12. An image forming apparatus that can perform image forming processing including forming a latent image on a charged photosensitive member and causing toner particles to adhere to the latent image, the image forming apparatus comprising:

a light irradiation unit configured to emit light based on a light-emission signal corresponding to an image to be formed and expose the photosensitive member in such a way as to form a latent image by irradiating and scanning the charged photosensitive member with light; and a signal generation unit configured to store information relating to a plurality of light-emission patterns having been set beforehand in accordance with an exposure amount of the photosensitive member exposed by the light irradiation unit, and configured to generate a plurality of light-emission signals based on the information relating to the plurality of light-emission patterns;

wherein the signal generation unit is configured to generate the plurality of light-emission signals corresponding to a plurality of pixels that constitutes the image based on information relating to the light-emission pattern, wherein the signal generation unit is configured to store information relating to a minute exposure light-emission pattern having been set beforehand, an exposure amount by which is smaller than an exposure amount by a light-emission pattern that causes toner particles to adhere to the photosensitive member, and generate a minute exposure-light emission oriented light-emission signal based on information relating to the minute exposure light-emission pattern, wherein the minute exposure light-emission oriented light-emission signal is at least one of the plurality of light-emission signals generated based on information relating to the plurality of light-emission patterns, and wherein in a state where the light irradiation unit performs scanning based on the minute exposure-light emission oriented light-emission signal, when the light irradiation unit scans respective portions corresponding to two pixels adjacently disposed in a scanning direction, at least one of (a) light-emission start timing of the light irradiation unit and (b) light-emission termination timing of the light irradiation unit is differentiated between the two pixels.

13. The image forming apparatus according to claim 12, wherein in a state where the light irradiation unit performs scanning based on the minute exposure-light emission oriented light-emission signal , when the light irradiation unit scans respective portions corresponding to two pixels adjacently disposed in the scanning direction, a time interval between the light-emission start timing and the light-emission termination timing of the light irradiation unit is kept the same and the light-emission start timing of the light irradiation unit is differentiated between the two pixels.

14. The image forming apparatus according to claim 12, wherein in a state where the light irradiation unit performs scanning based on the minute exposure-light emission oriented light-emission signal , when the light irradiation unit scans respective portions corresponding to two pixels adjacently disposed in the scanning direction, a time interval between the light-emission start timing and the light-emission termination timing of the light irradiation unit is differentiated between the two pixels.

15. The image forming apparatus according to claim 12, wherein in a state where the light irradiation unit performs scanning based on the minute exposure-light emission oriented light-emission signal , when the light irradiation unit scans respective portions corresponding to two pixels adjacently disposed in the scanning direction, the light irradiation unit does not emit light for a portion corresponding to one of the two pixels.

16. The image forming apparatus according to claim 12, wherein the light irradiation unit includes a deflection unit configured to move an irradiated light spot on a surface of the photosensitive member, and the scanning direction is a direction corresponding to a moving direction of the light spot moved by the deflection unit.

17. The image forming apparatus according to claim 12, wherein in a state where the light irradiation unit performs scanning based on the minute exposure-light emission oriented light-emission signal , when the light irradiation unit scans a portion corresponding to two pixels adjacently disposed in a direction perpendicular to the scanning direction, at least one of (a) light-emission start timing of the light irradiation unit and (b) light-emission termination timing of the light irradiation unit is differentiated between the two pixels.

18. The image forming apparatus according to claim 17, wherein in a state where the light irradiation unit performs scanning based on the minute exposure-light emission oriented light-emission signal , when the light irradiation unit scans a portion corresponding to two pixels adjacently disposed in a direction perpendicular to the scanning direction, the light irradiation unit does not emit light for a portion corresponding to one of the two pixels.

19. The image forming apparatus according to claim 12, wherein the light irradiation unit is configured to perform scanning by irradiating a plurality of charged photosensitive members with light, wherein the signal generation unit is configured to store information relating to a plurality of minute exposure light-emission patterns that corresponds to the plurality of photosensitive members, and the plurality of minute exposure light-emission patterns are mutually different light-emission patterns.

20. The image forming apparatus according to claim 12, wherein the light irradiation unit includes a plurality of light sources that irradiates one photosensitive member with light, and the signal generation unit is configured to generate a plurality of light-emission signals to cause the plurality of light sources to emit light, wherein the minute exposure light-emission pattern includes a plurality of light-emission patterns corresponding to the plurality of light-emission signals, and the plurality of light-emission patterns are mutually different light-emission patterns.

21. The image forming apparatus according to claim 12, wherein the signal generation unit is configured to receive print data corresponding to the image to be formed and generate the light-emission signal for each coordinate of the print data in such a way as to dispose a light-emission pattern corresponding to a density level of each coordinate from the plurality of light-emission patterns having been set beforehand.

22. The image forming apparatus according to claim 12, wherein the signal generation unit is configured to output the light-emission pattern in synchronization with a clock signal.

* * * * *